US006759004B1

(12) United States Patent
Dwivedi

(10) Patent No.: US 6,759,004 B1
(45) Date of Patent: Jul. 6, 2004

(54) PROCESS FOR FORMING MICROPOROUS METAL PARTS

(75) Inventor: Ratnesh K. Dwivedi, Thornton, PA (US)

(73) Assignee: Southco, Inc., Concordville, PA (US)

( * ) Notice: Subject to any disclaimer, the term of this patent is extended or adjusted under 35 U.S.C. 154(b) by 205 days.

(21) Appl. No.: 09/588,873

(22) Filed: Jun. 6, 2000

Related U.S. Application Data

(60) Provisional application No. 60/144,719, filed on Jul. 20, 1999.

(51) Int. Cl.[7] ..... B22F 3/10

(52) U.S. Cl. ..... 419/2; 419/36; 419/37; 419/41; 264/125; 264/126; 264/127; 264/56; 423/447.4; 423/447.5

(58) Field of Search ..... 419/2, 41, 36, 419/37; 264/125, 126, 127, 56; 423/447.4, 447.5

(56) References Cited

U.S. PATENT DOCUMENTS

| | | | | | |
|---|---|---|---|---|---|
| 3,802,878 | A | * | 4/1974 | Lindstrom | 75/208 R |
| 3,947,550 | A | * | 3/1976 | Fitchmun | 423/345 |
| 4,302,413 | A | * | 11/1981 | Howe et al. | 264/126 |
| 4,734,237 | A | | 3/1988 | Fanelli et al. | |
| 4,942,092 | A | * | 7/1990 | Takabayashi et al. | 428/401 |
| 5,033,939 | A | * | 7/1991 | Brasel | 419/37 |
| 5,100,736 | A | | 3/1992 | London et al. | |
| 5,139,977 | A | * | 8/1992 | Dwivedi | 501/127 |
| 5,145,616 | A | * | 9/1992 | Sadanobu et al. | 264/29.2 |
| 5,163,498 | A | * | 11/1992 | Kantner et al. | 164/97 |
| 5,304,520 | A | * | 4/1994 | Dwivedi | 501/127 |
| 5,847,017 | A | * | 12/1998 | Brandt | 521/91 |
| 5,848,351 | A | * | 12/1998 | Hoshino et al. | 428/550 |
| 5,902,529 | A | * | 5/1999 | Ishikawa et al. | 264/51 |
| 5,968,429 | A | * | 10/1999 | Treece et al. | 264/102 |
| 5,972,284 | A | * | 10/1999 | Lindsten et al. | 419/2 |
| 5,976,454 | A | * | 11/1999 | Sterzel et al. | 419/2 |
| 5,977,230 | A | | 11/1999 | Yang et al. | |
| 5,985,208 | A | | 11/1999 | Zedalis et al. | |
| 5,989,492 | A | * | 11/1999 | Larsson | 419/36 |
| 5,993,507 | A | | 11/1999 | Baum et al. | |
| 6,022,509 | A | * | 2/2000 | Matthews et al. | 419/38 |
| 6,056,915 | A | | 5/2000 | Behi et al. | |
| 6,171,532 | B1 | * | 1/2001 | Sterzel | 264/43 |

FOREIGN PATENT DOCUMENTS

| | | |
|---|---|---|
| WO | 98/08667 | 3/1998 |
| WO | 98/31521 | 7/1998 |
| WO | 99/00313 | 1/1999 |
| WO | 99/32543 | 7/1999 |
| WO | 99/32544 | 7/1999 |

OTHER PUBLICATIONS

Mark Eisenmann Porous Powder Metallurgy Technology pp. 1031 to 1042.

J. Banhart, J. Baumeister, and M. Weber, Fraunhofer—Institute for Applied Materials Research, Bremen Metallic Foams pp. 1043 to 1047.

Lewis, J., "Injection Technique Expands Foam–Metal Applications" Design News/Mar. 1, 1999, p. 135.

Advanced Materials & Processes 11/98 Chin–Jye (Mike) Yu* and Harald H. Eifert Metal Foams pp. 45–48.

Cymat Corporation Cymat—Material Handling, Technologies, and Aluminum Foam.

MKI—Martin Kurz & Co., Inc. Dynapore 2 pages.

(List continued on next page.)

*Primary Examiner*—Daniel J. Jenkins
(74) *Attorney, Agent, or Firm*—Paul & Paul

(57) ABSTRACT

A metal injection-molding feedstock is heated and plasticized. Supercritical carbon dioxide is injected into the feedstock to form micropores when the pressure is reduced and a parts mold is filled. The micropores are retained when the green parts are debindered and sintered.

20 Claims, 21 Drawing Sheets

OTHER PUBLICATIONS

Mott Corporation Mott Porous Metal. The Key Ingredient to Enhance Food Processing Productivity Why and Where Food and Beverage Processors Use Mott Media. 4 pages.
UltraMet Ultramet Foams.
Andrew J. Sherman, Robert H. Tuffias, and Richard B. Kaplan, Refractory Ceramic Foams: A Novel New High Temperature Structure 6 pages.
National Center for Excellence in Metalworking Technology Porous Metallurgy Materials Engineering Knowledge Base (Included article) Office of Naval Research New Class of Material Based on Metal Foams Has Potential for Wide Range of Applications Released Feb. 1, 1999.

* cited by examiner

PROCESS FOR FORMING MICROPOROUS METAL PARTS

Thus application claims the benefit of No. 60/144,719, filed Jul. 20, 1999.

BACKGROUND OF INVENTION

1. Field of the Invention

The present invention relates to processes for forming metal and/or ceramic parts and in particular to molding processes for forming metal and/or ceramic parts.

2. Brief Description of the Prior Art

Porous metals are of interest as structural materials where high specific stiffness, defined as the ratio of stiffness to density, is desired, such as for metal parts for a variety of applications.

Currently, a number of methods exist for producing porous metal structures.

One is by constructing a honeycomb or similar structure by bonding, brazing, welding or diffusion bonding individual components forming the structure.

Another way of producing porous metal structures is by introducing gas into metallic melts. For example, aluminum alloy melts can be exposed to hydrogen, which dissolves in the molten metal. The dissolved gas is released upon solidification of the melt resulting in porosity. The porosity generated by this method is not controlled and varies in uniformity and size. For this reason, this technique is not commercially useful.

Yet another technique of producing porous metal structures relies on soaking a polymer sponge with a slurry consisting of metal powder and a polymer binder. The soaked sponge is subsequently dried and fired to bum off the polymer sponge skeleton, leaving behind a metal skeleton that is subsequently sintered to a porous metal part. The shape of the porous metal structure is dictated by the shape of the sponge. Structures with highly interconnected porosity can be formed by this technique. The parts produced by this technique are used as filters and catalyst supports. The pore size of the metal parts produced using this technique is generally large. It is difficult to produce parts that have pore sizes smaller than 1 mm. Furthermore, this technique cannot be used to produce complex parts or structures requiring closed porosity or good surface finish.

Foaming agents of various types have been used to produce porous metal structures. The foaming agents are incorporated into the solid metal. In a version of this process aluminum alloy metal powder is mixed with titanium hydride and the mixture is formed into shapes, such as sheets and rods, the shapes thus produced are then heated above the melting point of the aluminum alloy and the foaming agent decomposes releasing hydrogen that foams the metal. This foamed liquid alloy must be quickly cooled to preserve the porous structure. However, this process is difficult to control because of small a processing window. Since metals have very low viscosity compared to polymers, the growth of the gas bubbles can proceed very rapidly, resulting in large pores. This process generally results in pores that are larger than one millimeter in size. The pore size and distribution are generally not very uniform. This process is being commercialized for simple shapes such as sheets and rods. Complex shapes are more difficult to produce by this method.

There are other processes that are based on the same principle wherein the foaming agent is part of the metallic system. For example, when iron ore is reduced using hydrogen, a porous structure results because the product of reaction causes the structure to form pores. Such metals are called sponge metals. The pores are generally interconnected and large. This process is hard to control and is not used in commercial production of the structural parts. Similar structures are also produced in a process commonly called self-propagating syntheses. An example of this process involves burning titanium metal powder in an atmosphere of nitrogen gas. The titanium metal powder is placed in a container and is ignited at a predetermined temperature. The chemical reaction leading to titanium nitride generates enough energy to heat adjoining titanium powder to continue this reaction. Porous titanium nitride is generally produced in such a reaction.

Porous metal structures can also be produced when a sintering operation in a powder metal fabrication process in not taken to completion. For example if a pressed powder metal part consisting of more than 50 volume percent porosity is only lightly sintered to form a bond between particles, a porous structure containing interconnected porosity results. These structures are commercially used as filters for fluids and in self-lubricating bearings. The primary disadvantage of this process is the interconnectedness of the pores and the large pore size. When attempts are made to produce closed porosity using this technique, generally low porosity results.

There is a need for a method of producing porous metal parts of well-defined shape with high proportion of small, closed porosity and good surface finish.

There are a variety of processes known for producing microcellular foams using synthetic organic polymeric materials. One such process employing an injection-molding machine is disclosed in International Patent Application WO 98/31521 and assigned to Trexel, Inc. In the Trexel process a molten polymer is mixed with a supercritical fluid, generally carbon dioxide or nitrogen. The supercritical fluid is intimately mixed with the polymer during the process. Gas bubbles are nucleated by rapid decompression of the supercritical fluid/polymer mixture. The process is controllable and can produce polymer parts containing varying proportion of porosity of various size ranges. The process is well suited for producing parts that have from 10 to greater than 90 percent porosity, with pore size ranging between 10 to 100 microns.

Processes such as extrusion and injection molding can be modified to produce parts using this technology. A number of polymers, including polyethylene, polystyrene, and polypropylene can be processed using this process.

Metal injection molding ("MIM") is a process that is extensively used for producing net shaped, intricate metal parts. This process is disclosed, for example, in U.S. Pat. No. 4,734,237. In the MIM process, fine metal powder is mixed with a binder phase to produce feedstock for an injection molding operation carried out at a later stage. The binder phase essentially consists of a component that can hold the metal particles together after the molding process and is easily removed via chemical leaching or heat before the sintering operation. A number of other chemicals are added to modify the properties of the slurry to make it more amenable to molding. These include dispersants, wetting agents, etc. The process of removing binder by chemical leaching and/or thermal reaction from a metal injection molded shape is called debinding or debindering. Once the parts are debindered they are sintered under appropriate conditions to produce metal parts. This process has been used to produce metal parts that have low porosity.

Two types of binders have been used in the MIM feedstocks: thermoset and thermoplastic. The thermoplastic binders are by far the most popular. There are a number of proprietary and non-proprietary binder systems in use in industry. Some of the common binders are based on polyethylene, polystyrene or polypropylene, polysaccharides, et al.

SUMMARY OF THE INVENTION

The present invention provides a process for producing metal parts with uniformly distributed porosity of small size and good surface finish. In the present process, a metal injection molding (MIM) feedstock is processed to produce a "green part" containing uniformly distributed porosity under 1000 microns in size, and preferably in the range between 10 and 100 microns in size. Once the green part having the porous structure has been formed, the binder is removed by conventional debindering procedures, and the porous green part is sintered. During the sintering process, the interstitial porosity, that is the porosity between the metal powder particles, is eliminated, leaving behind the uniformly distributed porosity, generally closed, that was produced by the gas during the molding process. The metal parts formed by the present process have a dense, generally pore-free surface. The process can also be used to extrude microporous metal structures.

The present invention provides a process for forming microporous metal parts or structures. The process comprises providing a feedstock including powdered metal and a binder, injection molding or extruding the feedstock to provide a porous green part or structure, debindering the porous part or structure to substantially remove the binder, and then sintering the porous part or structure. The sintering step reduces or eliminates interstitial pores in the structure.

The injection-molding step preferably comprises heating the feedstock to a temperature greater than the melting point of the binder to provide a plasticized feedstock, mixing a pore-forming agent (for example, a gas under pressure or a supercritical fluid) with the plasticized feedstock; and filling a mold with the plasticized feedstock. The plasticized feedstock is preferably permitted to cool in the mold to provide a solid green part. When forming extruded shapes or structures, the plasticized feedstock including the pore-forming agent is extruded through a die, and preferably cools as the plasticized feedstock is being extruded.

Preferably, the injection-molding step further comprises applying pressure to the plasticized feedstock, injecting the pore-forming agent into the pressurized plasticized feedstock, reducing the pressure before filling the mold, and permitting the plasticized feedstock to solidify in the mold. It is preferred that the pore-forming agent be injected into the pressurized plasticized feedstock as a supercritical fluid, the pore-forming agent then forming a gas when the pressure is reduced. Nitrogen and carbon dioxide are preferred pore-forming agents, and in particular, super-critical carbon dioxide is preferred as a pore-forming agent for injection into the pressurized plasticized feedstock.

Preferably, the feedstock includes a metal powder having a particle size distribution optimized for maximum packing. Preferably, the powdered metal is selected from the group consisting of carbon steel, stainless steel, iron, nickel alloys, cobalt alloys, tool steels, metal carbides, nickel aluminide, molybdenum alloys, tungsten alloys, bronze, aluminum and titanium. Preferably, the binder is a thermoplastic polymeric material. It is preferred that the binder be selected from the group consisting of wax, agar, polyethylene, polyethylene oxide, polypropylene, and polystyrene.

The present invention thus provides microporous metal parts having closed interior pores with a diameter less than about 1000 microns and a dense surface skin, and in particular microporous metal parts wherein the interior pores have a size from about 10 microns to 100 microns.

DETAILED DISCLOSURE

Figures 1, 1A, 1B, 1C, 1D:
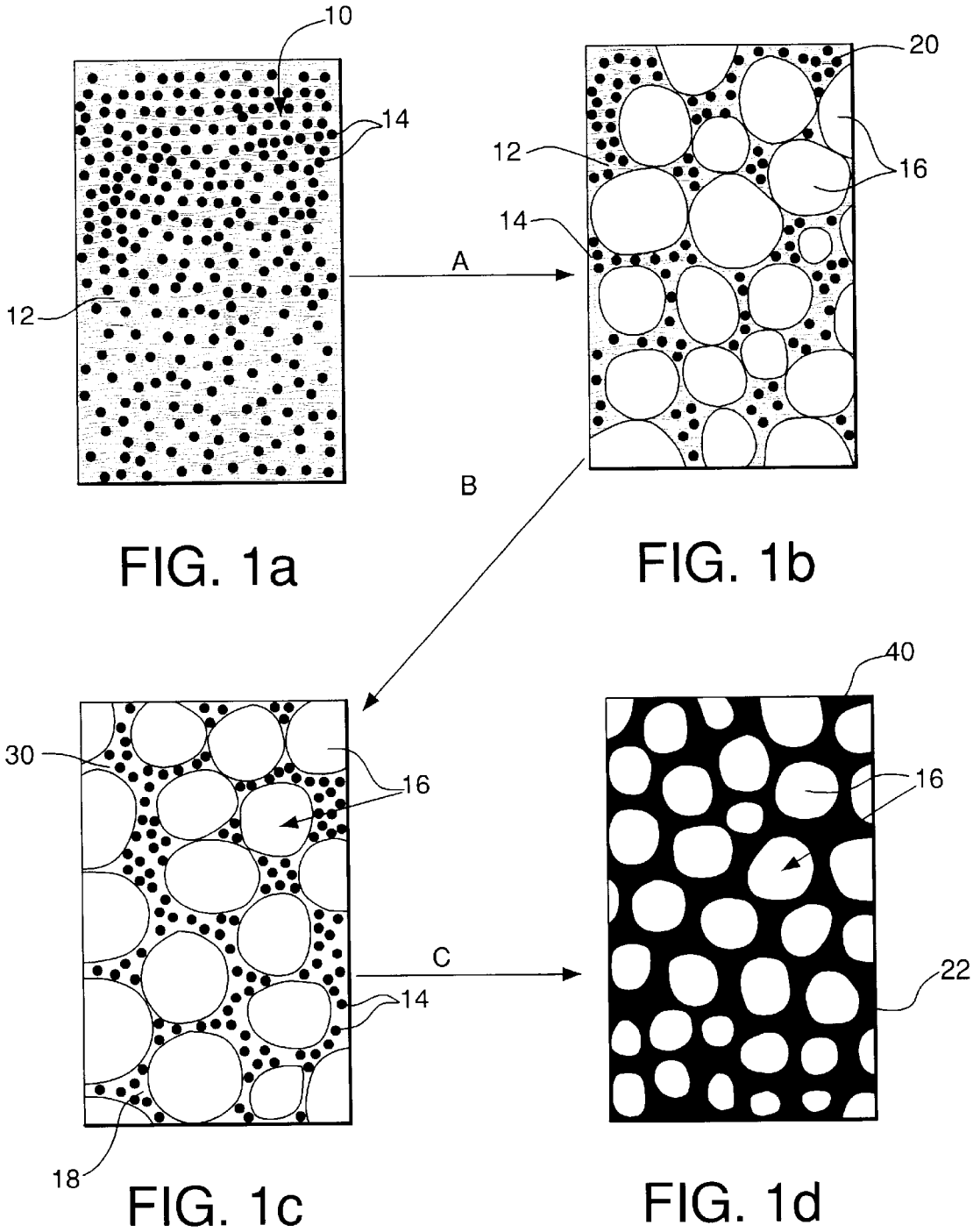
FIG. 1 is a schematic illustration showing the effect of the process of the present invention on the structure of the material being processed.

The process of the present invention is illustrated schematically in FIG. 1, including FIGS. 1*a*–1*d*. FIG. 1*a* depicts metal injection molding feedstock 10, which includes a binder phase 12, and a discrete metal powder phase 14. Physically, the feedstock 10 typically takes the form of small, uniformly sized granules that can be easily melted in the screw of an injection-molding machine.

The metal powder 14 is preferably a MIM grade metal powder. Preferably, the metal powder has a particle size distribution optimized for maximum packing of the powder. The metal particle shape can be generally spherical, although irregularly shaped particles such as those produced by water-atomization processes can interlock to provide greater strength to green parts, which may be desirable for handling the green parts. The specific metal powder employed depends upon the nature of the part to be prepared by the present process. By "metal powder" is meant powders of metals, alloys, intermetallic compounds, and mixtures thereof. Examples of metal powders that can be used include iron, carbon steel, stainless steel, tool steels, metal carbides, aluminum, copper, nickel, gold, silver, titanium, niobium, tantalum, zirconium, copper alloys including bronze, nickel alloys, cobalt alloys, molybdenum alloys, tungsten alloys, intermetallic compounds, iron aluminide ($Fe_3Al$), and nickel aluminide. Examples of metal powders available in MIM-grades include stainless steel, iron, bronze, aluminum and titanium.

The binder used can be any suitable binder such as a wax, a natural or synthetic organic polymeric material, including polysaccharides, gelatins such as agar, polymers and copolymers of acrylic and methacrylic acid and their esters, acrylamide, ethyl and propylene glycol, vinyl acetate, and the like; polyolefins such as polyethylene and polypropylene; polyvinyl chloride, polyethylene carbonate and polystyrene, and mixtures thereof. The polymeric material can be thermoplastic or thermosetting, or mixtures of thermoplastic and thermosetting materials can be employed. Amorphous, crystalline and semi-crystalline polymeric materials can be used. As is known in the art, the binder can include one or more additives for various purposes, such as flow additives and shape retention or "backbone" additives such as plasticized thermosetting organic materials. Suitability of the binder depends on the compatibility with the metal powder and processing additives, toxicity, strength, storage stability, the flow properties of the binder during injection molding, and the ease with which the binder can be removed during debindering operations. The concentration of the binder can be from about 5 to 60 volume %, based on the total composition.

As explained below, and expressed schematically by arrow A in FIG. 1, the feedstock 10 including a suitable binder 12 is preferably processed using an injection molding machine, modified to inject carbon dioxide under pressure and temperature above its critical point into the plasticized feedstock.

As the MIM feedstock 10 moves along the barrel of the injection molding machine, pressure and temperature of the binder increases, and the binder melts to provide a molten slurry of metal particles dispersed in the hot, plasticized fluid binder. The hot, pressurized slurry is mixed with a pore-forming agent, preferably in the form of supercritical fluid, such as carbon dioxide or nitrogen. Gas bubbles are believed to be nucleated in the molten binder containing supercritical fluid as the pressure is decreased when the slurry is injected into a mold. As shown in FIG. 1*b,* the bubbles form closed cells or pores 16 of relatively uniform size in the green part 20 shaped by the mold. The pores 16 in the green part 20 are defined by a matrix comprising the metal powder particles 14 and the now solidified binder 12.

The molded green part 20 is then released from the mold and is subjected to the debindering operation, as shown schematically by arrow B in FIG. 1. The debindering can be carried out by chemical leaching, by heating the part in a furnace to burn off the binder, or by a combination of chemical leaching and heating. As shown schematically in FIG. 1*c,* the resulting debindered green part 30 retains the closed pores 16 formed in the injection molding process step, and the metal powder 14. However, the binder 12 has now been replaced by interstitial open pores 18.

As depicted schematically by step C of FIG. 1, once the binder has been leached away or burnt off, the debindered green part 30 is subjected to sintering in a furnace under appropriate conditions, to sinter together the metal powder particles 14. During the sintering process, the metal powder particles coalesce together to form a substantially continuous solid metal phase 22, and the interstitial porosity 18 is substantially eliminated. As shown schematically in FIG. 1*d,* the resulting part 40 retains the closed pores 16 formed by the gas. The size of the pores has been reduced from those in the green part as a result of shrinkage. During the sintering process, the green part 30 undergoes about 15 to 25 percent shrinkage in all dimensions.

A similar process is used to form porous metal extrusions, except that microporous shapes or structures are extruded from a suitable die positioned at the end of a suitably modified plastics extrusion machine.

Examples of injection molding machines suitable for the practice of the present invention are disclosed in International Patent Publications WO 98/08667 and WO 98/31521, the disclosures of which are both hereby incorporated by reference herein, can be employed in the process of the present invention. Such injection molding machines are similar to injection molding machines conventionally used in plastic injection molding except for a few modifications to facilitate injection of the pore-forming fluid and thorough mixing of the pore-forming fluid with molten feedstock under pressure.

Figure 2:
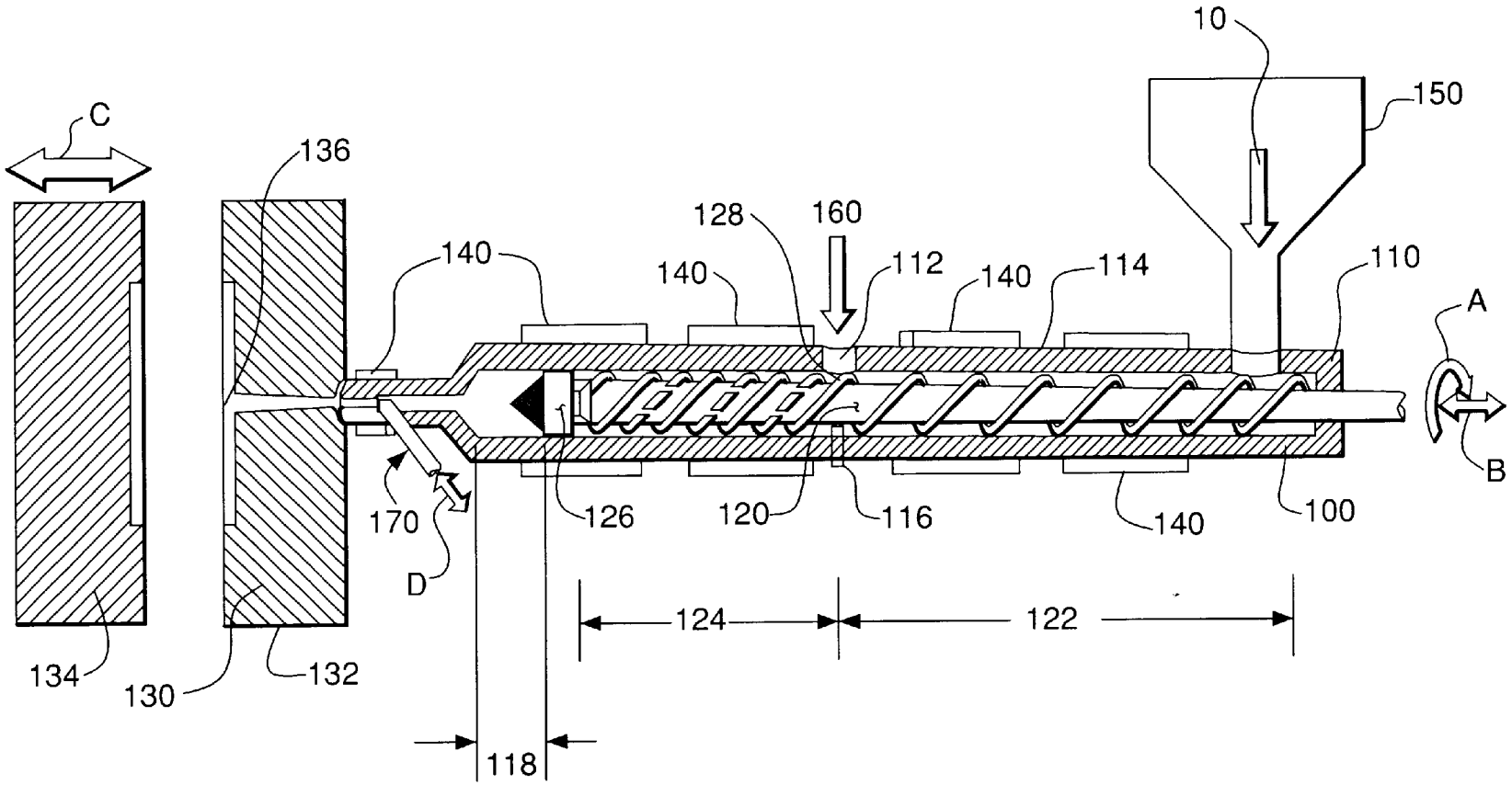
FIG. 2 is a schematic illustration showing the apparatus employed in the process of the present invention.

An injection-molding machine 100 useful for the process of the present invention is illustrated schematically in FIG. 2. The construction of the injection-molding machine is similar to conventional injection molding machines used for plastic injection molding, except that a modified barrel 110 and screw 120 are employed. The barrel 110 is modified to provide a port 112 for injection of a pore-forming fluid under pressure in a heated section 114. The screw 120 includes a conventional conveying section 122 but is modified by adding a mixing section 124 in front of the screw tip 126. The screw speed is the circumferential speed of rotation of the screw during the material conveying and mixing cycle. Additionally, a port 116 is added to the barrel to measure pressure at the gas injection location 128 inside the barrel 110.

The injection-molding machine 100 is operated in a conventional, cyclic manner, with a shot of molten feedstock being accumulated within the rearward end 118 of the barrel 110. When a sufficiently large shot has accumulated, the screw 120 is hydraulically displaced within the barrel 110 forcing the shot of molten feedstock into the mold 130. The cycle time is the length of time elapsed between two injection events. The dose stroke is the length in front of the screw 120 inside the barrel 110 that is filled with the material to be injected into the mold 130. This length includes a cushion (added volume of material beyond that required to fill the cavity) to prevent the screw tip 126 from hitting the end of the barrel 110 and maintain pressure until the mold gate 136 is frozen off, to prevent back flow.

In order to injection mold a part, the composite portions (a front, stationary section 132 and a back, moving section 134) of a mold 130 for the part to be manufactured are attached to platens (not shown). The mold 130 and the barrel 110 are heated to a predetermined temperature. The barrel 110 is heated by band heaters 140 positioned along its length.

The feedstock 10 is fed to the injection-molding machine 100 from a hopper 150. As the screw 120 rotates, the feedstock 10 is conveyed along the screw 120 while being heated at the same time. As the feedstock 10 is heated it melts while continuing to move towards the mold 130 by the action of rotating screw 120. Once the molten feedstock 10 reaches the injection port 112 carbon dioxide 160 is injected under pressure (carbon dioxide believed to be in the supercritical fluid state) into the molten feedstock 10 using a nozzle that has fine holes (not shown). The gas pressure is always maintained at a higher level than the pressure of molten feedstock, back pressure, imposed as a result of screw rotation so that the gas mixes in with the feedstock and the feedstock does not flow into injection port 112.

The carbon dioxide 160 is injected into the barrel 110 via a nozzle containing numerous fine holes (not shown). The polymer binder in the feedstock 10 dissolves some of the carbon dioxide forming a fluid that is believed to be supersaturated with the carbon dioxide. A predetermined mixing time is allowed for the molten feedstock to mix with the gas under pressure. The molten feedstock containing dissolved carbon dioxide gas continues to advance along the screw 120 and subsequently injected into the mold 130 under the action of hydraulic pressure applied to the screw 120 using hydraulic ram (not shown). The back pressure and the injection pressure are both measured in the hydraulic fluid. The injection pressure is the pressure at which the material is injected into the mold. The back pressure is the pressure maintained on the molten feedstock while it is being conveyed along the screw and during the residence time. The residence time is when the screw is not conveying or injecting material.

Before injection of the material into the mold 130, a nozzle valve 170 is opened and remains open while the material is injected into the mold 130. As the material is injected into the mold 130, there is a sudden decrease in pressure, causing the dissolved gas to homogeneously nucleate within the polymer and grow. The growth of the gas bubbles is arrested by the cooling of the feedstock in the mold 130, resulting in relatively uniform gas bubbles distributed through the thickness of the part.

Once the part in the mold 130 has been formed it is allowed to cool and ejected. The closure of the mold 130 is insured by a clamping force applied to the moving half 134 of the mold 130. The clamping force is the force required to clamp the two mold halves 132, 134 together during the material injection and part cooling cycles. Once the injection of the material is complete and nozzle 170 closes and the dose area in front of the screw 120 is filled up with the fresh feedstock with dissolved gas for the next shot. The shot weight is the weight of the molten feedstock injected into the mold 130 during each injection cycle.

EXAMPLE 1

A conventional metal injection molding feedstock consisting of fine iron powder (spherical iron powder, 1–7 micron in diameter) and a proprietary thermoplastic polymer binder (6% by weight of metal powder), "blended 4600 steel," was supplied by Advanced Metalworking Practices, Inc., 12227 Crestwood Dr., Carmel, Ind. 46033. The feedstock was granulated so that it could be directly fed to an injection molding machine in a manner similar to conventional plastic injection-molding granules.

A modified injection molding machine, supplied by Arburg Inc., 125 Rockwell Rd., Newington, Conn. 06131, "Alrounder C500-250 Jubilee" had a capacity to exert a clamping force of 55 metric tonnes. The screw and barrel of the machine were modified in order to form microcellular plastics. A gas injection port was located in the middle section of the barrel through which carbon dioxide at a high pressure was injected into the plasticized metal feedstock as it traveled along the heated barrel. Average barrel temperature was maintained at approximately 190° C., while the average mold temperature was maintained at approximately 43° C. A ring mold for producing Southco M 1-61-1 Mounting Bracket, Southco Inc. 210 N. Brinton Lake Rd., Concordville, Pa. 19331-0116, was used. In order to produce the green parts from the metal feedstock, the mold was closed and an adequate clamping force was maintained. The feedstock was fed into the front section of the barrel where it was rapidly heated to 190° C. and plasticized as it was transported to the front section of the barrel by movement of the screw. As the feedstock moved into the heated part of the barrel it melted (plasticized) and was compressed. The pressure in the molten feedstock reached approximately 21 MPa when carbon dioxide at 28 MPa was injected into the molten feedstock through fine orifices. The mass flow rate of the carbon dioxide fluid was 320 g/hr. The circumferential speed of screw rotation was maintained at 245 mm/sec. The special design of the screw aided in the dispersion and partial or full dissolution of the carbon dioxide fluid into the thermoplastic binder. Bubbles were nucleated into the feedstock as the binder underwent rapid decompression just as it was injected into the ring-mold at 110 MPa. The overall cycle time for this operation was measured at 33.5 seconds.

Figure 3:
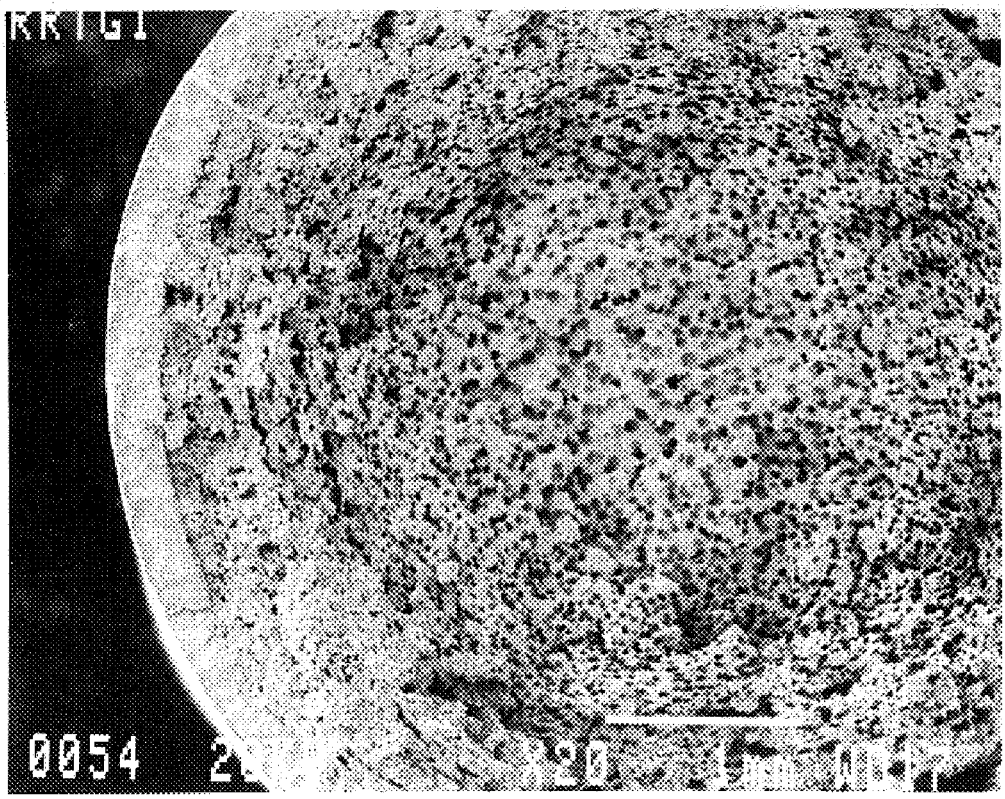
FIG. 3 is an SEM micrograph of a section of a green cylindrical part produced according to the process of the present invention, and having a microporous interior and a dense skin.
Figure 4:
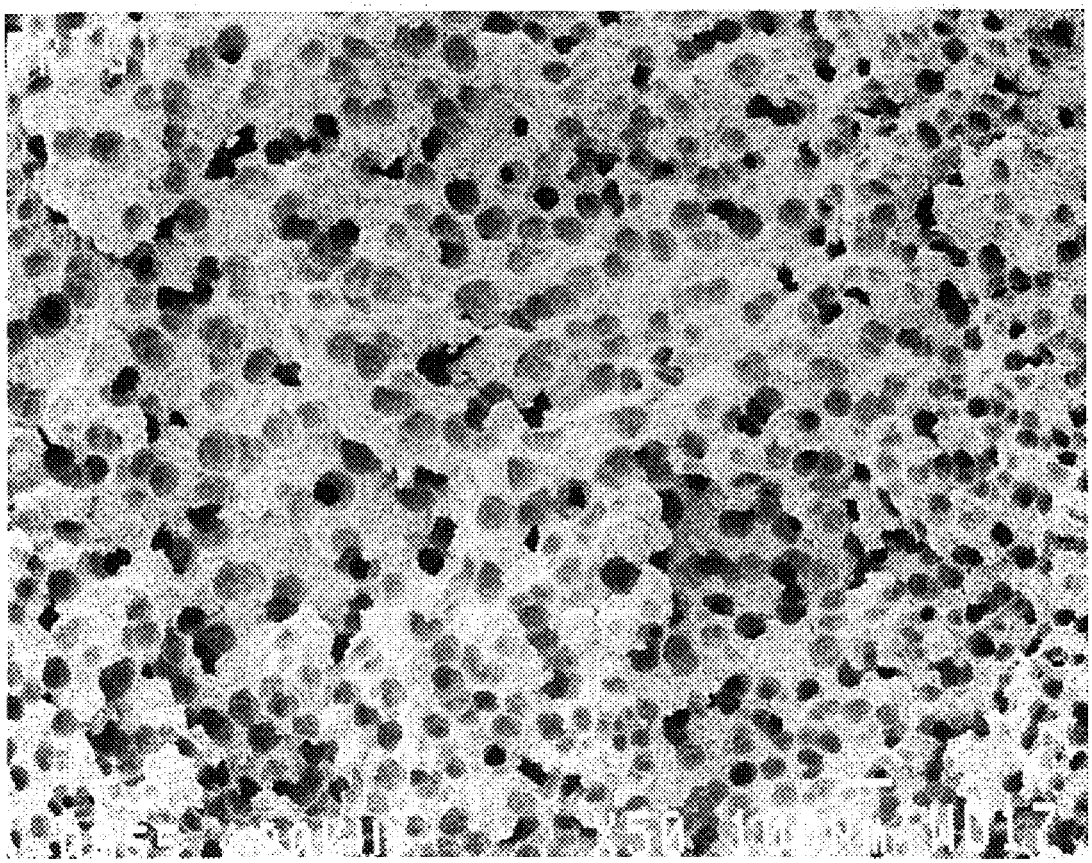
FIG. 4 is an SEM micrograph of the green part of FIG. 3 at a higher magnification, in which micropores approximately 30 to 80 microns in diameter are clearly identifiable.
Figure 5:
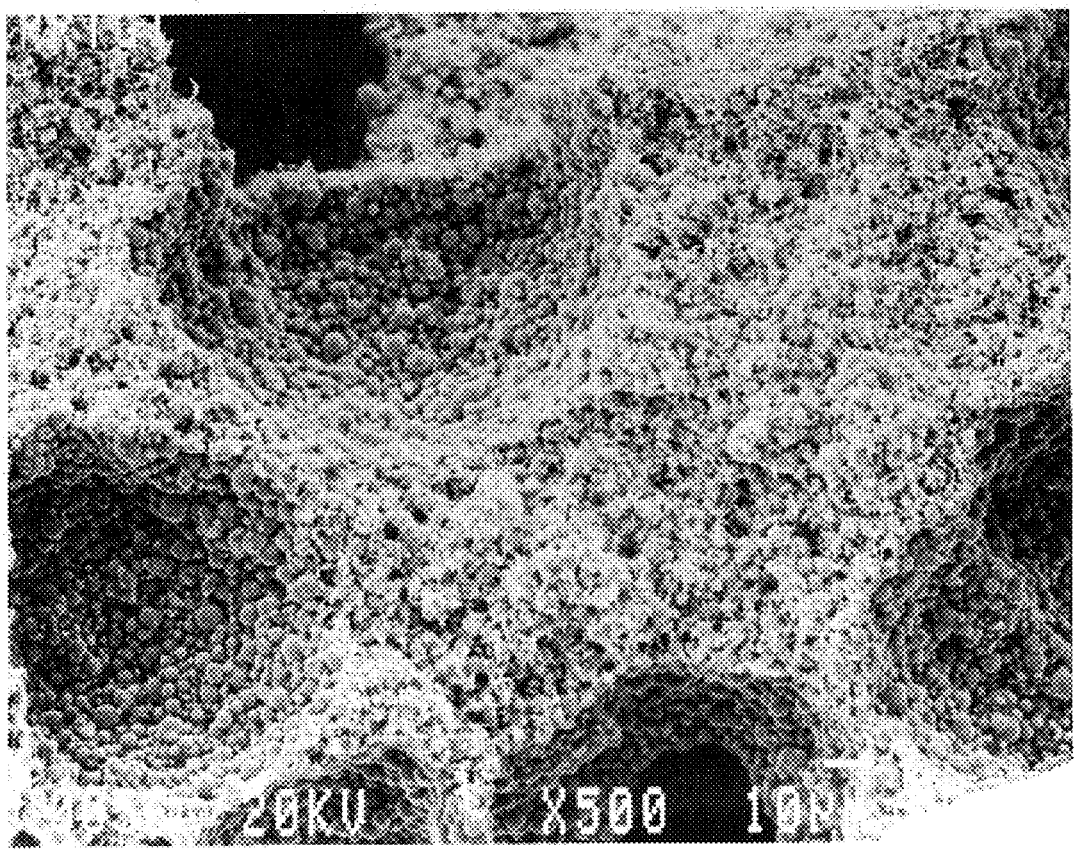
FIG. 5 is an SEM micrograph of the green part of FIG. 3 at a high magnification, in which the spherical metal particles 1–3 micron in diameter comprising the metal feedstock can be seen, as well as large depressions of micropores formed by injected fluid.
Figure 6:
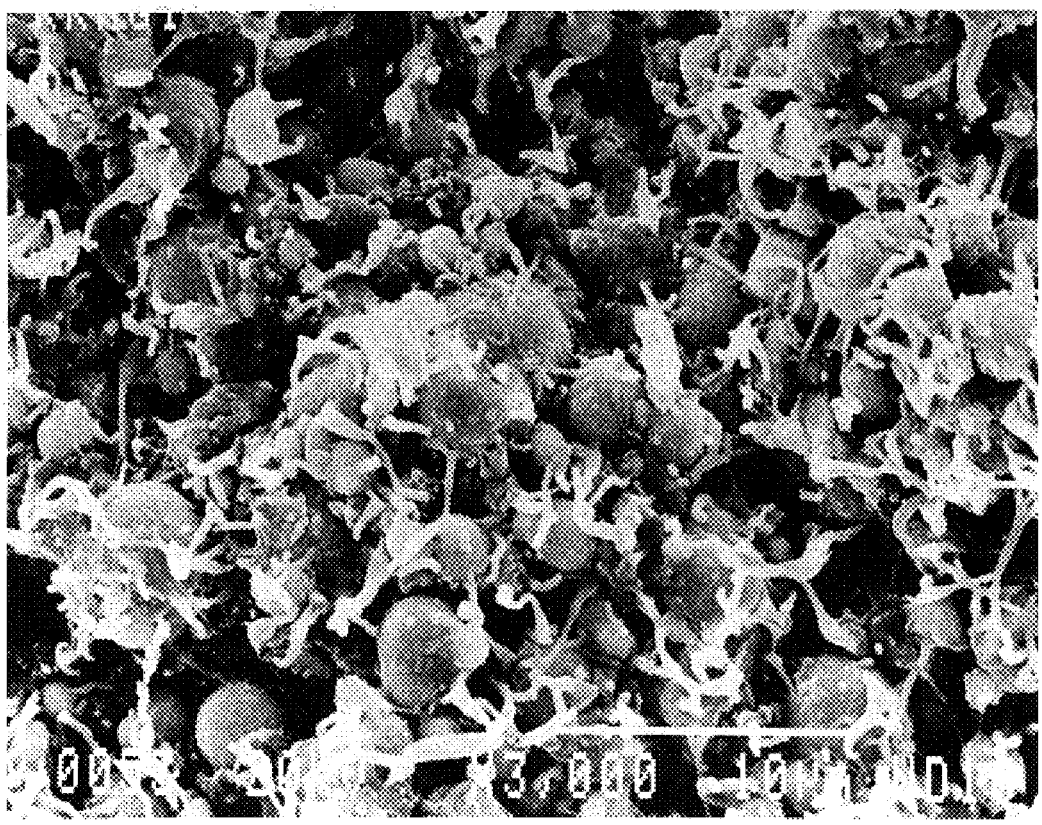
FIG. 6 is an SEM micrograph of the green part of FIG. 3 at a high magnification.
Figure 7:
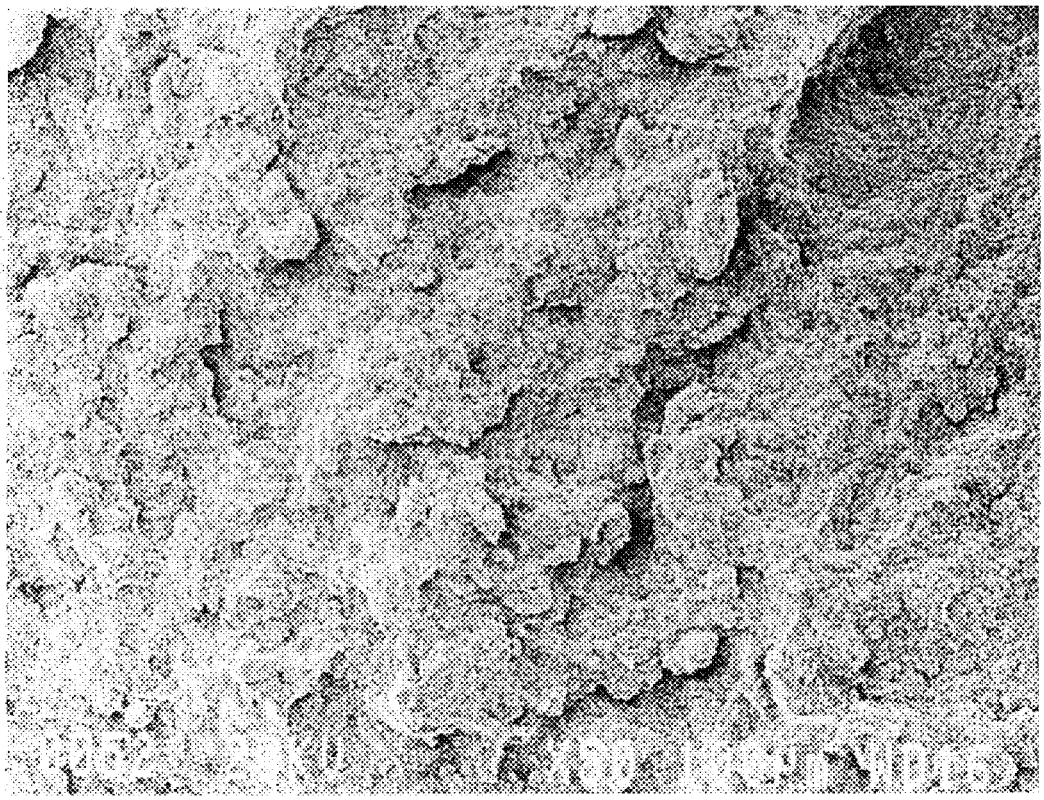
FIG. 7 is an SEM micrograph of the part of a comparative example in which the plasticized metal feedstock was not subjected to gas injection, shown at a high magnification, and evidencing the absence of micropores.

Once the feedstock was injected into the mold, it was allowed to cool, whereupon it took the shape of the mold. The part was then ejected from the mold, yielding a "green" part. The green parts were basically shaped parts where the metal powder is held together by the thermoplastic polymer binder. These parts were still quite warm when they are ejected from the mold and were allowed to cool and, subsequently, weighed. The weight of the green ring which was subjected to gas injection was approximately 53 g. The weight of the same part without gas injection was approximately 58 g. The green parts were then fractured to examine their internal microstructure. A scanning electron microscope (SEM) was used to examine the fracture surface (after coating the surface with a layer of gold) of the green parts. FIG. 3 shows a SEM micrograph of the fracture surface of a green part with a generally circular cross section. This cross section clearly shows the formation of micropores in the interior of the part and a dense skin on the surface. FIG. 4 shows a more detailed view of this section. The pores formed by the gas appear to be fairly uniform and spherical. The estimated size (diameter) of the pores ranged from 30 to 80 microns. FIG. 5 shows an SEM micrograph of the fracture surface of a section with a generally circular cross-section of a green part at a higher magnification. This micrograph clearly shows the construction of the material. The round metallic particles (also shown in FIG. 6) comprising the feedstock are clearly visible. The micropores formed due to gas injection appear as the large depressions. FIG. 7 shows SEM micrographs of a fracture surface that was produced following the procedure described above, except no fluid was injected into the molten feedstock during injection molding. Clearly, no micropores were formed. After examination of the green parts it was concluded that, just as in plastics, the micropores could be formed in a metal feedstock by injecting gas.

Figure 8:
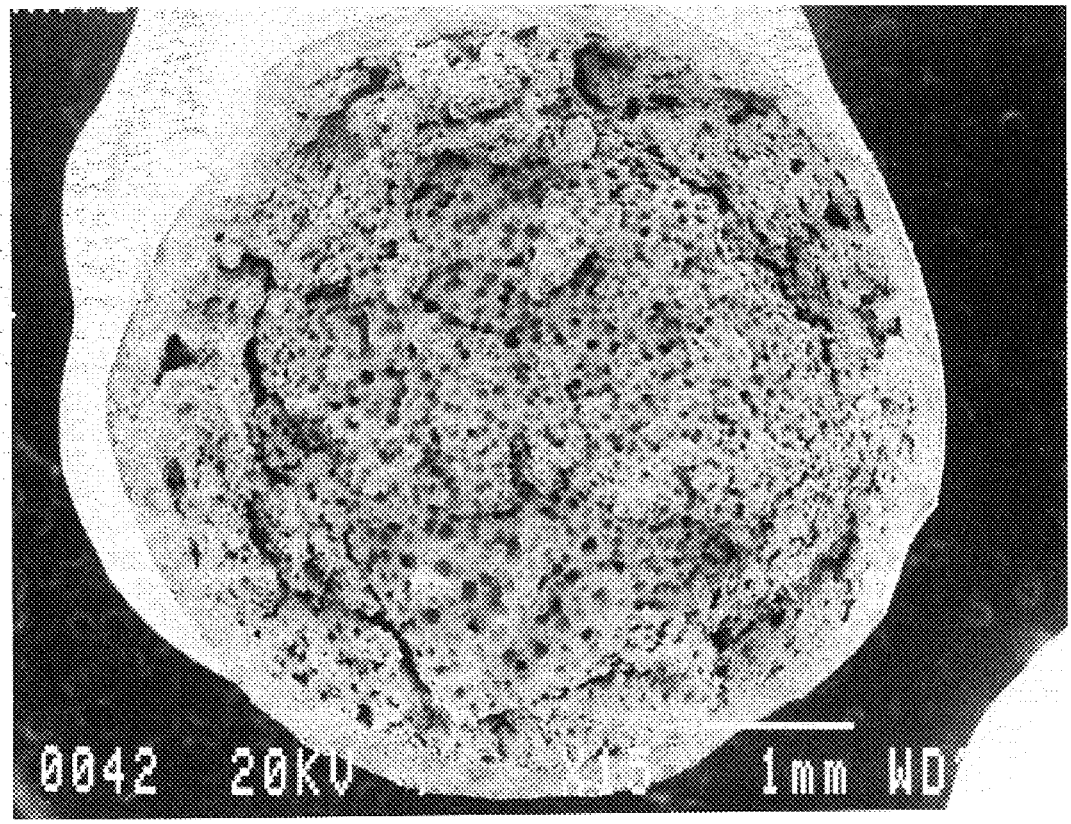
FIG. 8 is an SEM micrograph of the part of FIG. 3 after sintering, showing that the morphology of the microstructure remains unchanged from the green state. However, the parts do undergo approximately 18% linear shrinkage during debindering and sintering.
Figure 9:
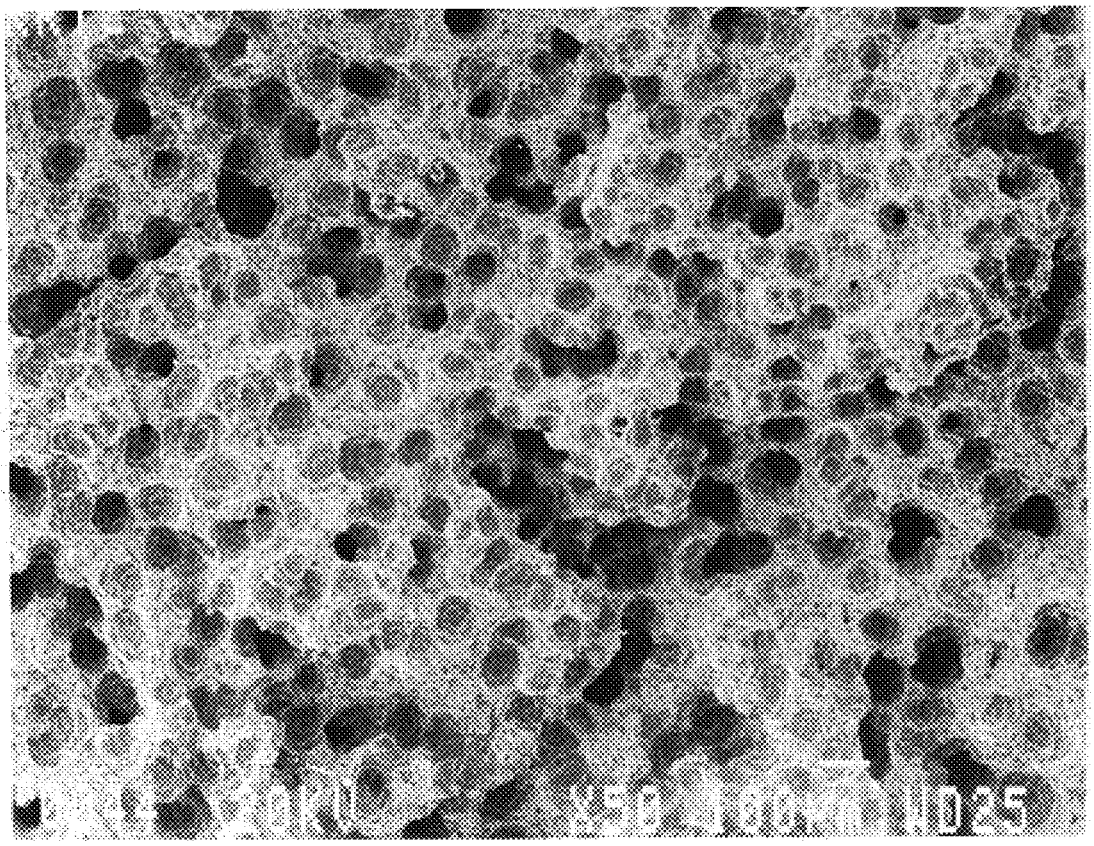
FIG. 9 is an SEM micrograph of a fracture surface of the part of FIG. 3 after sintering.

The green parts were subsequently subjected to debindering and sintering to impart strength and structural integrity to the parts. Debindering and sintering was carried out by Elnik Systems, 4 Edison Place, Fairfield, N.J. 07004-3501. The samples were debindered and sintered in a batch furnace that could be used, optionally, under controlled atmosphere or vacuum. The samples were loaded in refractory trays and placed in the furnace. The furnace was then heated to 130° C. in 300 minutes under 300 torr of nitrogen pressure. The furnace was then heated to 250° C. in 90 minutes under the same nitrogen pressure. The samples were held at this temperature for 1 hour. The temperature was then raised to 350° C. over 200 minutes and, subsequently to 550° C. in 90 minutes. The nitrogen partial pressure was still maintained at 300 torr at these processing steps. At 550° C., the samples were held for an hour and were then heated to 1000° C. over 300 minutes and held there for 1 hour still under 300 torr of nitrogen. The temperature of the furnace was then increased to 1275° C. over 200 minutes and the vacuum was turned on. Under these conditions the samples were sintered for one hour before cooling. The samples were then fractured to reveal the structure of the interior. FIG. 8 shows a scanning electron micrograph of the fracture surfaces of sintered parts. These samples were fabricated by introducing carbon dioxide during the injection molding process of the metal feedstock. The following features in the samples are clearly visible: All samples had a well-defined microporous structure in the interior with a dense skin on the surface. The pore structure was well defined and had a similar morphology as the green parts. The pore structure formed in the plasticized state due to gas injection that was observed in the green state was maintained during the sintering operation. The micrograph of FIG. 9 reveals the morphology of the pores at a higher magnification.

These results show that a pressurized fluid could be incorporated into the metal injection molding feedstock during injection molding, giving rise to a microporous structure with a dense skin similar to that found with the polymer-based feedstocks (plastics). The results also show that the morphology of this structure is maintained through the sintering process, giving metal components with a microporous interior and a dense skin.

EXAMPLE 2

This example shows that the formation of micropores is not affected by metal alloy chemistry when using the same binder system.

Feedstocks containing alloy powders of three different chemistries (Table A) were procured from Advanced Metalworking Practices (AMP), Inc. (12227 Crestwood Dr., Carmel, Ind. 46033). All of these feedstocks contained a proprietary binder system developed by AMP. The key properties of these feedstocks are shown in Table A. The Blended 4600 Feedstock was produced by mixing carbonyl iron powder (iron powder derived by the carbonyl process), 2% nickel powder and the proprietary binder developed by AMP. The size and the origin of the nickel powder was not disclosed by AMP. The particle size of the carbonyl iron powder ranged between 1 to 7 microns, with the average particle size of about 4 microns. This feedstock was found to contain approximately 10% binder, as determined by the weight difference in as-molded and sintered parts. The formulation sheets from AMP indicated the binder level to be 7.6%.

The Prealloyed 316L stainless steel feedstock was produced by mixing gas atomized 316L stainless steel powder (maximum particle size of 16 microns) with the proprietary AMP binder. The gas-atomized powders are generally spherical in shape and give higher packing densities. The binder level in the feedstock was found to be 6.5%, as measured by the weight loss measurements. The formulation sheet from AMP indicated the binder level to be 6.0%.

The M4 tool steel feedstock was also produced from gas atomized M4 tool steel powder. The maximum particle size of this powder was limited to 22 microns. The binder level in the M4 feedstock was determined to be 7% from the weight loss measurements even though the formulation sheets for this feedstock from AMP indicated the binder level to be 6.0%.

The viscosity of levels of Blended 4600, 316L and M4 tool steel feedstocks were determined to be 17170 P, 10120 P and 7420 P, respectively, as measured by capillary rheometer at 175° C.

The density of these feedstocks was measured to be 4.845 g/ml, 5.279 g/mL and 5.338 g/ml, respectively.

TABLE A

Feedstocks with Varying Alloy Chemistries

| Feedstock | Alloy Powder | Particle Size Distribution of Alloy Powder | Binder Level (formulation sheet) | Weight Percent Binder | Viscosity at 175° C. (P) | Density of Feedstock (g/mL) |
|---|---|---|---|---|---|---|
| Blended 4600 | 98% Fe (carbonyl)<br>2% Ni | Average - 4 microns | 7.6% | 10 | 17170 | 4.845 |
| Pre-alloyed 316L stainless steel, gas-atomized | 16.50% Cr<br>10.309% Ni<br>2.12% Mo<br><2% Mn<br><0.03% C<br><0.03% S<br><1% Si<br>balance Fe | Maximum particle size 16 microns | 6% | 6.5 | 10120 | 5.279 |

TABLE A-continued

Feedstocks with Varying Alloy Chemistries

| Feedstock | Alloy Powder | Particle Size Distribution of Alloy Powder | Binder Level (formulation sheet) | Weight Percent Binder | Viscosity at 175° C. (P) | Density of Feedstock (g/mL) |
|---|---|---|---|---|---|---|
| Pre-alloyed M4 tool steel, gas-atomized | 1.35% C<br>4.28% Cr<br>4.66% Mo<br>6.00% W<br>4.00% V<br>balance Fe | Maximum particle size 22 microns | 6.0% | 7.0 | 7420 | 5.338 |

TABLE B

Processing Conditions for the Feedstocks of Different Alloy Chemistries

| | | | |
|---|---|---|---|
| Feedstock Chemistry | 4600 | 316L | M4 |
| Feedstock Supplier | AMP | AMP | AMP |
| Feedstock Trade Name | Blended 4600 Steel | Prealloyed 316L | Prealloyed M4 |
| Metal Powder Size (microns) | 4 | <16 | <22 |
| Feedstock Bulk Density (g/m L) | 4.845 | 5.279 | 5.338 |
| Part Geometry | Tensile Bar (E1.7357) | Tensile Bar (E1.7357) | Tensile Bar (E1.7357) |
| Shot Weight (g) | 55.4 | 59.8 | 64.3 |
| Dose Stroke (mm) | 20 | 20 | 22 |
| Cycle Time (s) | 32.03 | 37.08 | 36.12 |
| Screw Speed (mm/s) | 762 | 762 | 762 |
| Mixing Time (s) | 4.06 | 1.22 | 2.28 |
| Back Pressure (MPa) | 17 | 16 | 16 |
| Injection Time (s) | 0.31 | 0.34 | 0.36 |
| Injection Pressure (MPa) | 34 | 69 | 77 |
| Clamping force (tons) | 30 | 30 | 30 |
| Barrel Temperature (Feeder to Nozzle) | | | |
| Zone 1 (° C.) | 215 | 203 | 203 |
| Zone 2 (° C.) | 204 | 216 | 216 |
| Zone 3 (° C.) | 190 | 185 | 185 |
| Zone 4 (° C.) | 177 | 178 | 178 |
| Zone 5 (° C.) | 232 | 202 | 205 |
| Mold Temperature | | | |
| Side A, near nozzle (° C.) | 24 | 24 | 24 |
| Side B, away from nozzle (° C.) | 15 | 24 | 24 |
| Gas pressure (MPa) | 23 | 25.5 | 25.5 |

The feedstocks were processed using the Arburg injection-molding machine described in the previous Example 1. The conditions under which a feedstock was processed are provided in Table B. The conditions could not be maintained identically for each feedstock since each feedstock had different rheological characteristics due to the difference in volume fraction of alloy powder and particle size distribution. The experiments were conducted so that they yielded acceptable molded parts. As can be noted, the injection pressures for 4600 feedstock was substantially lower that those used in the injection of 316L and M4 feedstocks. Several runs were made using each feedstock.

For most of the feedstock samples a mold capable of producing dogbone shaped tensile test specimen was used. However for the Blended 4600 and pre-alloyed 316L feedstocks a latch handle mold was also used.

After injection molding, the parts were sent to Taurus International Manufacturing, Inc., 175 N.W. 49th Avenue, Miami, Fla. 33014-6314, for debindering and sintering.

Figure 10:
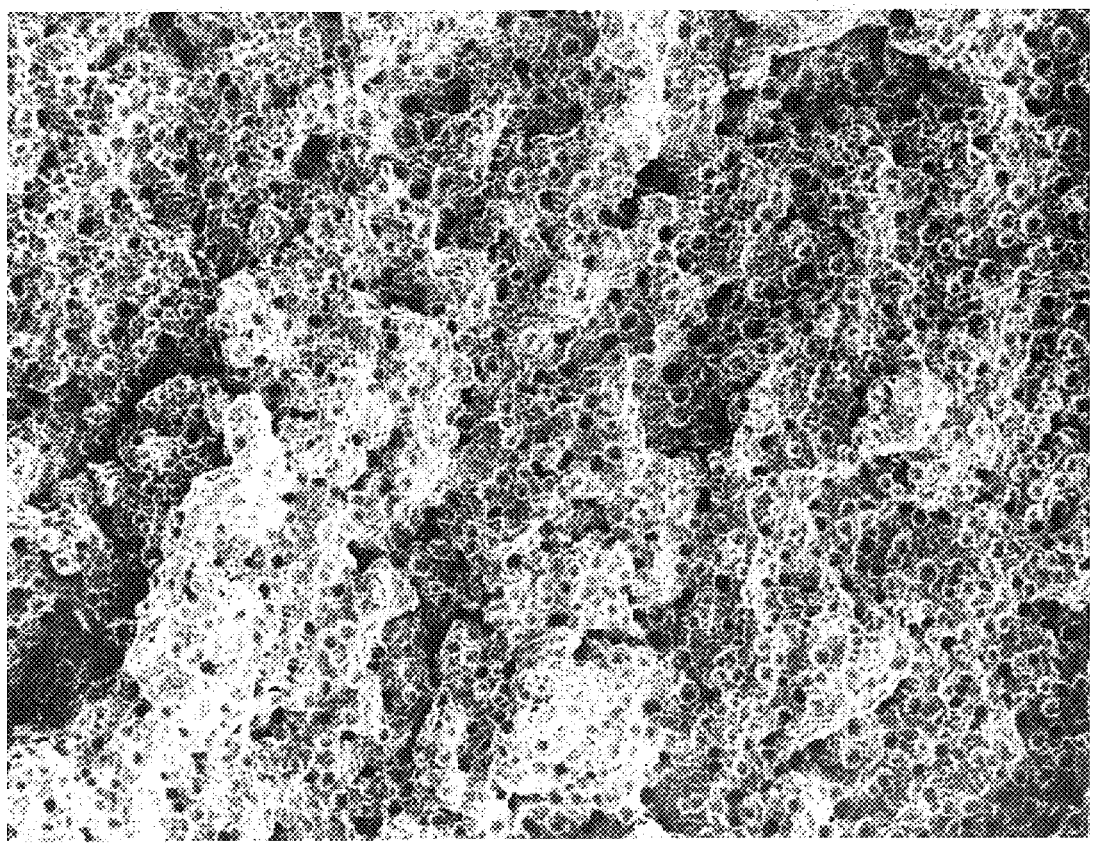
FIG. 10 is an SEM micrograph of a fracture surface of a part produced using a Blended 4600 feedstock.

In order to examine the internal microstructure of the samples, both green and sintered parts were fractured and examined under a scanning electron microscope (SEM). The molded samples appeared very similar to those described in the previous Example 1, showing the formation of micro-pores throughout the samples. This structure was maintained through the debindering and sintering. The photomicrograph of FIG. 10 shows the fracture surface of a tensile bar produced from the Blended 4600 steel feedstock after sintering. The magnification of the micrograph of FIG. 10 is 25×. The micrograph clearly shows that the micro-pores formed during the injection molding are preserved during the sintering process and their morphology is substantially unchanged. The sample shown in FIG. 10 contained oval-shaped pores between 10 to 40 microns in diameter. The distribution of the pores in a particular section of the sample (e.g. section shown in the photomicrograph) was fairly uniform. However, the volume fraction and the size of pores varied in different sections within a sample.

Figure 11:
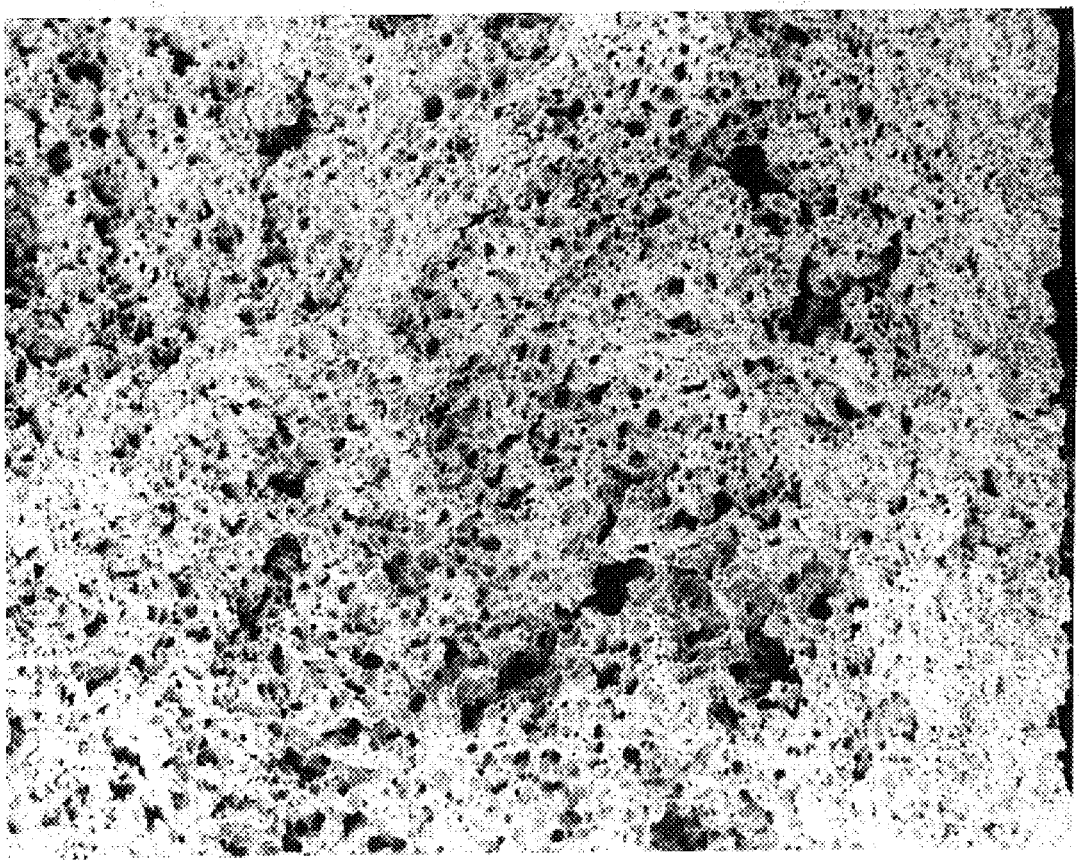
FIG. 11 is an SEM micrograph of a fracture surface of a part produced using Pre-alloyed 316 stainless steel feedstock.

The photomicrograph in FIG. 11 shows the microstructure of the fracture surface of a tensile bar produced from Pre-alloyed 316L stainless steel feedstock after sintering, at a magnification of 50×. FIG. 11 also shows the dense skin on the surface of the tensile bar. As shown in the FIG. 11, the morphology of the pores in this sample is quite different from that in the sample produced from the Blended 4600 steel feedstock due to the difference in the Theological properties of the two feedstocks. Qualitatively, the 4600 steel appeared to contain higher volume fraction of porosity.

Figure 12:
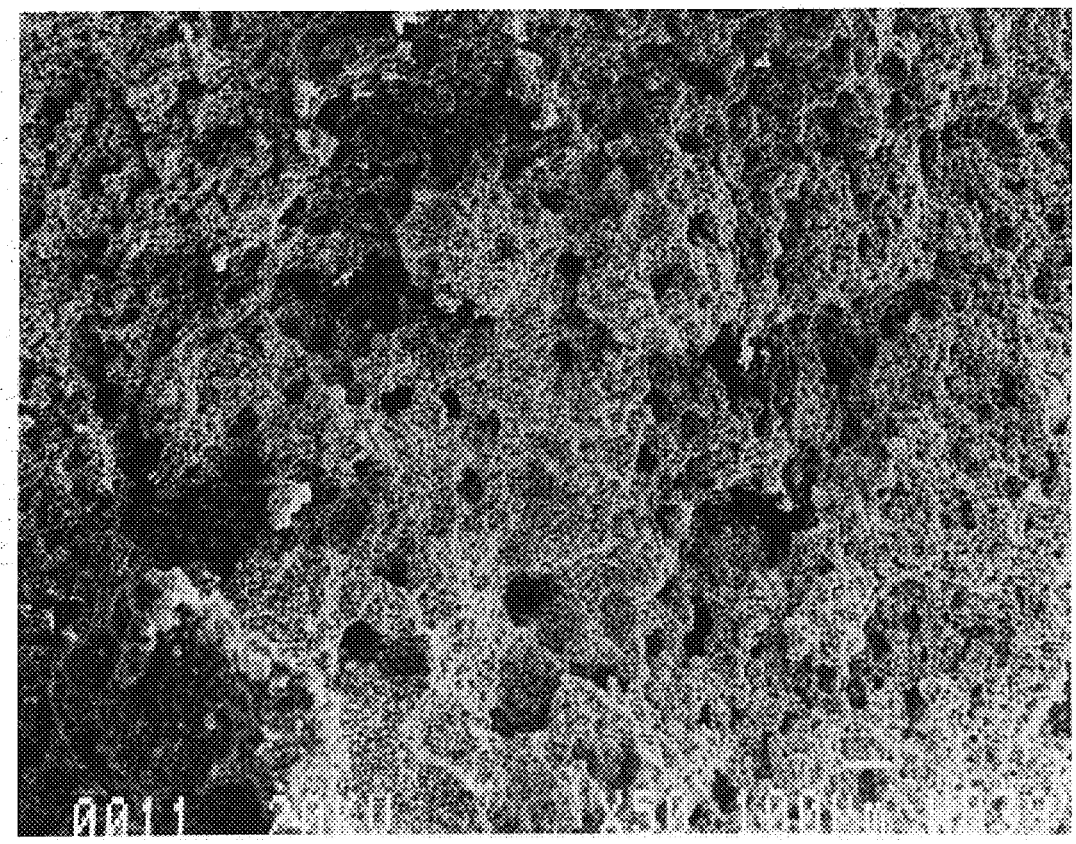
FIG. 12 is an SEM micrograph of a fracture surface of a part produced using Pre-alloyed M4 tool steel feedstock.

The Pre-alloyed M4 feedstock was the most difficult to process. The photomicrograph in FIG. 12 (50× magnification) clearly shows the evidence of pore formation in this feedstock but the formation of pores was not as widespread as seen in the samples produced using the Blended 4600 steel and Pre-alloyed 316L stainless steel feedstocks. The distribution of pores was also not as uniform as that seen with the other two feedstocks. The micrograph in FIG. 12 was taken from a sample in the as-molded state and shows the spherical metal particles contained in the feedstock.

It is believed that the difference in the morphology of the samples produced from different feedstocks may have been caused by the difference in particle size of the metal powders used in their production. The feedstock containing finer metal powders (e.g. 4600 steel with average particle size of 4 microns) appears to show finer and more uniformly distributed pores as compared to the feedstocks containing coarser metal powders (e.g. 316L at 16 micron and M4 at 22 microns).

The primary conclusion from this experiment is that the formation of micro-pores takes place during injection molding when a gas is introduced into the molten feedstock during the mixing process, irrespective of the chemistry of the alloy powders contained in the feedstock.

However, the microstructures of the samples produced from various feedstocks were not identical, due to the differences in rheological properties of the feedstocks and the processing conditions used during their production.

EXAMPLE 3

This example shows that micro-porous metals can be formed using feedstocks that contain different binder systems.

Commercial feedstocks were purchased from a number of suppliers. In addition, one feedstock was custom formulated with a known binder. Since most of the feedstock systems are proprietary, only limited information about the chemistry and composition of the binder systems is supplied by the feedstock producers.

Table C gives some of the key characteristics of the feedstocks and the binders contained therein. Tables D1 an D2 provide the process parameters used with the feedstocks having different binder chemistries.

AMP (Advanced Metalworking Practices, Inc., 12227 Crestwood Dr., Carmel, Ind. 46033) supplied two of the feedstocks used in this study. The Blended 4600 steel feedstock was prepared by blending carbonyl iron powder with 2% nickel powder.

TABLE C

Characteristics of Feedstock and Binder Systems

| Feedstock Chemistry | Trade Name | Binder Chemistry | Binder Level (wt %) | Supplier |
|---|---|---|---|---|
| Blended 4600 steel | None | thermoplastic wax | 10 | AMP |
| Pre-alloyed 316L stainless steel | None | thermoplastic wax | 6–5 | AMP |
| Pre-alloyed 316L stainless steel | Aquamim PT-PIM316L-X | 4–6% polyvinyl alcohol, 1–1.5% polyethylene | 6–8 | Planet Polymer |
| Pre-alloyed 316L stainless steel | Catamold 316L | polyacetate | Not Known | BASF |
| Carbonyl iron | None | polystyrene | 9–10% | Southco |

TABLE D1

Process Parameters Used with Feedstocks of Different Binder Chemistries

| Feedstock Chemistry | Blended 4600 steel | Pre-alloyed 316L stainless steel | Pre-alloyed 316L stainless steel |
|---|---|---|---|
| Feedstock Supplier | AMP | AMP | Planet Polymer |
| Feedstock Trade Name | | | Aquamim PT. PIM316L.X |
| Metal Powder Size (microns | 4 | <16 | <22 |
| Feedstock Bulk Density (g/mL) | | | 4.5–5.5 |
| Part Geometry | Tensile Bar (E1.7357) | Tensile Bar (E1.7357) | Tensile Bar (E1.7357) |
| Shot Weight (g) | 55.4 | 59.8 | 63.5 |
| Dose Stroke (mm) | 20 | 20 | 30 |
| Cycle Time (seconds) | 32.03 | 37.08 | 21.76 |
| Screw Speed (mm/sec) | 762 | 254 | 254 |
| Mixing Time (seconds) | 4.06 | 1.22 | 2.78 |

TABLE D1-continued

Process Parameters Used with Feedstocks of Different Binder Chemistries

| | | | |
|---|---|---|---|
| Back Pressure (MPa) | 17 | 16 | 14 |
| Injection Time (seconds) | 0.31 | 0.34 | 0.70–6.00 difficult to inject |
| Injection Pressure (MPa) | 62 | 69 | 84 |
| Clamping Force (tons) | 30 | 30 | 30 |
| Barrel Temperatures (Feeder To Nozzle) | | | |
| Zone 1 (° C.) | 215 | 203 | 190 |
| Zone 2 (° C.) | 204 | 216 | 223 |
| Zone 3 (° C.) | 191 | 185 | 215 |
| Zone 4 (° C.) | 177 | 178 | 213 |
| Zone 5 (° C.) | 232 | 202 | 179 |
| Mold Temperatures | | | |
| Side A, near nozzle (° C.) | 24 | 24 | 52 |
| Side B, away from nozzle (° C.) | 24 | 24 | 52 |
| Gas Pressure (MPa) | 23 | 25 | 24 |

TABLE D2

Process Parameters Used with Feedstocks of Different Binder Chemistries

| Feedstock Chemistry | Pre-alloyed 316L stainless steel | Carbonyl iron |
|---|---|---|
| Feedstock Supplier | BASF | Southco |
| Feedstock Trade Name | Catamold 316L | |
| Metal Powder Size (microns | <22 | 4.3 |
| Feedstock Bulk Density (g/mL) | | 4.78 |
| Part Geometry | Tensile Bar (E1.7357) | Tensile Bar (E1.7357) |
| Shot Weight (g) | 65.4 | 53 |
| Dose Stroke (mm) | 23 | 33 |
| Cycle Time (seconds) | 31.3 | 31 |
| Screw Speed (mm/sec) | 203 | 178 |
| Mixing Time (seconds) | 3.13 | 1.8 |
| Back Pressure (MPa) | 7 | 7 |
| Injection Time (seconds) | 0.44 | 0.36 |
| Injection Pressure (MPa) | 99 | 34 |
| Clamping Force (tons) | 30 | 30 |
| Barrel Temperatures (Feeder To Nozzle) | | |
| Zone 1 (° C.) | 224 | 246 |
| Zone 2 (° C.) | 224 | 246 |
| Zone 3 (° C.) | 221 | 246 |
| Zone 4 (° C.) | 221 | 246 |
| Zone 5 (° C.) | 221 | 246 |
| Mold Temperature | | |
| Side A, near nozzle (° C.) | 82 | 74 |
| Side B, away from nozzle (° C.) | 82 | 74 |
| Gas Pressure (MPa) | 25 | 22 |

The binder was based on thermoplastic wax but its exact chemistry and composition was not disclosed by AMP. The samples produced using AMP feedstocks were subjected to debindering and sintering as in Example 1. These conditions are listed in Tables D1 and D2. The debindering and sintering of the samples produced from AMP feedstock was carried out by Taurus International.

The Planet Polymer (9985 Businesspark Ave., Suite A, San Diego, Calif. 92131) feedstock, Aquamim PT-PIM316L-X, used a two component binder system. One of the components, polyvinyl alcohol, is water soluble while the other component polyethylene, is insoluble in water. During the solvent debindering operation, the water soluble component, polyvinyl alcohol, can be dissolved in water, leaving only polyethylene for subsequent removal by thermal debindering. It is believed that the feedstock contains between 6 to 8 weight percent binder. After the parts were injection molded under the conditions listed in Tables D1 and D2, the parts were debindered in flowing hot water between 80 to 100 degrees centigrade. During this treatment, most of the polyvinyl alcohol was removed, leaving polyethylene holding the part together. After debindering in water the parts are subjected to thermal debindering in a retort furnace in flowing hydrogen. The time-temperature schedule for this operation was: heat to 450° C. at 3°0 C./min, hold at 450° C. for 1 hour, heat to 950° C. at a rate of 3° C./min, hold at 950° C. for 1 hour, heat to 1360 C. at 10° C./min, hold at 1360° C. for 1 hour, and furnace cool. The debindering and sintering of the samples produced from the Planet Polymer feedstock was carried out by Taurus International.

The BASF (1609 Biddle Ave., Wyandotte, Mich. 48192) feedstock, Catamold 316L, uses polyacetal as the primary binder. After the parts were injection molded using the parameters listed in Tables D1 and D2, the parts were subjected to solvent debindering using fuming nitric acid (99.5%). A carrier gas such as nitrogen carried the acid vapors to the molded parts wherein the acid vapors reacted with the polyacetal binder at 110 to 140° C., forming formaldehyde vapor that escapes and subsequently burnt in the afterburner. Since the melting point of the polyacetal binder is 165° C., the solid binder is directly converted into vapor phase without melting during the debindering process. The samples were then heated in nitrogen to 600° C. at a rate of 5 to 10° C./min and held at this temperature for 1 to 2 hour. This was followed by heating to 1360° C., sintering for 1 to 2 hour and furnace-cooling.

In addition to the above commercially available feedstocks, a feedstock was formulated by Southco for optimum pore formation using polystyrene as the primary binder phase. This feedstock was also processed using the parameters listed in the Tables D1 and D2.

The microporous structure was formed in samples produced using feedstocks produced from various binder systems investigated.

The AMP feedstock was one of the easiest feedstocks to process. The micro-pores formed in all AMP feedstocks irrespective of the metal powder chemistry. The feedstock containing carbonyl powder was easiest to process of all the AMP feedstocks and yielded the most uniform microstructure. The microstructures of the samples produced from AMP feedstocks have already been shown in the previous examples. The Planet Polymer feedstock was more difficult to process. It appeared that the gas dissolution during injection molding was less in this feedstock as compared to that seen in the AMP feedstock. This may be due to a higher solubility of carbon dioxide in the AMP feedstock.

Figure 13:
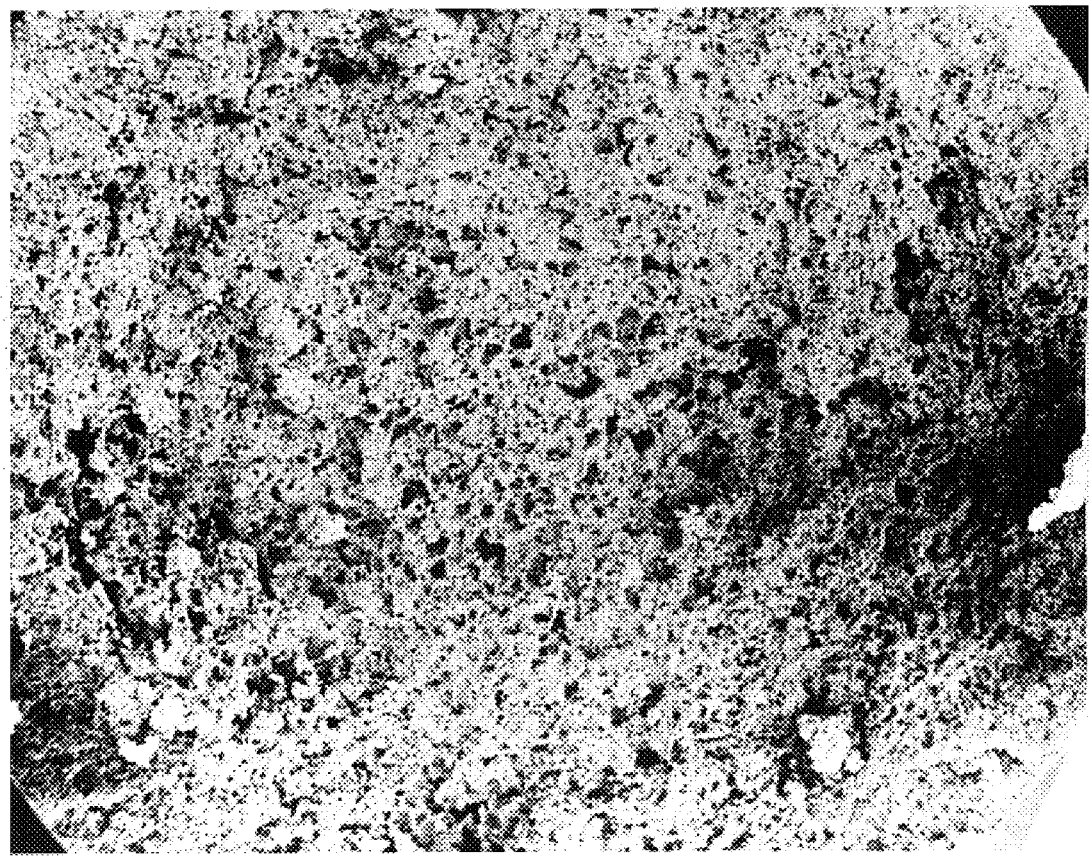
FIG. 13 is an SEM micrograph of a fracture surface of a part produced using Pre-alloyed 316L stainless steel feedstock.
Figure 14:
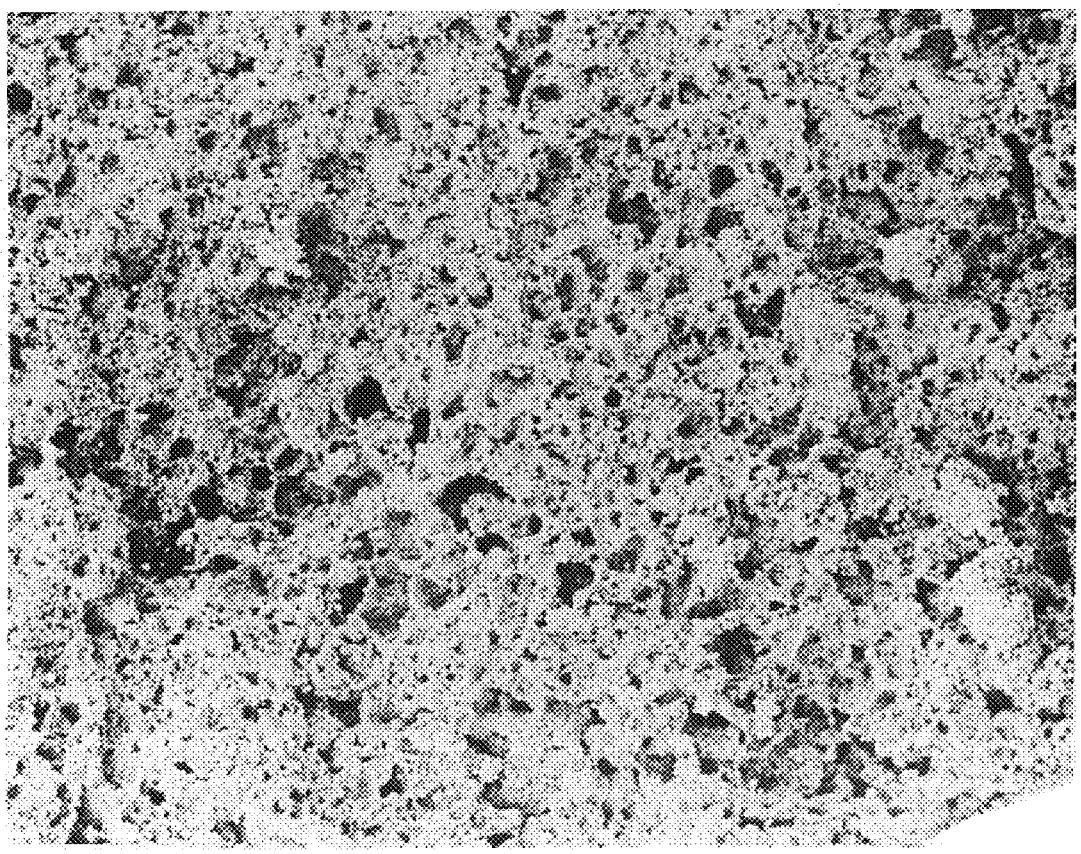
FIG. 14 is an SEM micrograph of the part of FIG. 13 shown at higher magnification.

FIG. 13 is a micrograph showing the microstructure of the fracture surface of an injection molded part produced from BASF Catamold 316L at a magnification of 20×. It clearly shows the formation of pores in the interior of the part while forming a dense skin on the surface. FIG. 14 shows the interior of this sample at a higher magnification. The samples from BASF feedstock were not sintered since it was well-established that the pores formed during injection molding were preserved through the sintering process.

Figure 15:
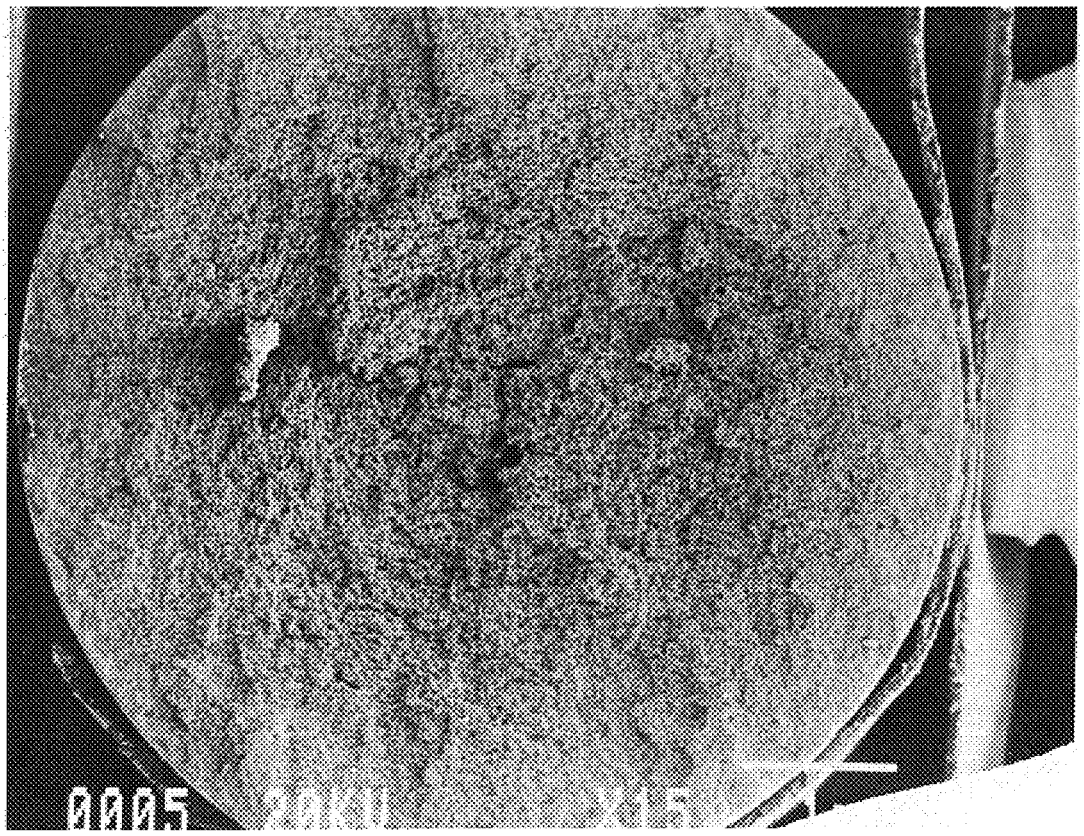
FIG. 15 is an SEM micrograph of a fracture surface of a part having a circular cross-section and produced using a custom-formulated feedstock containing polystyrene as the primary binder.
Figure 16:
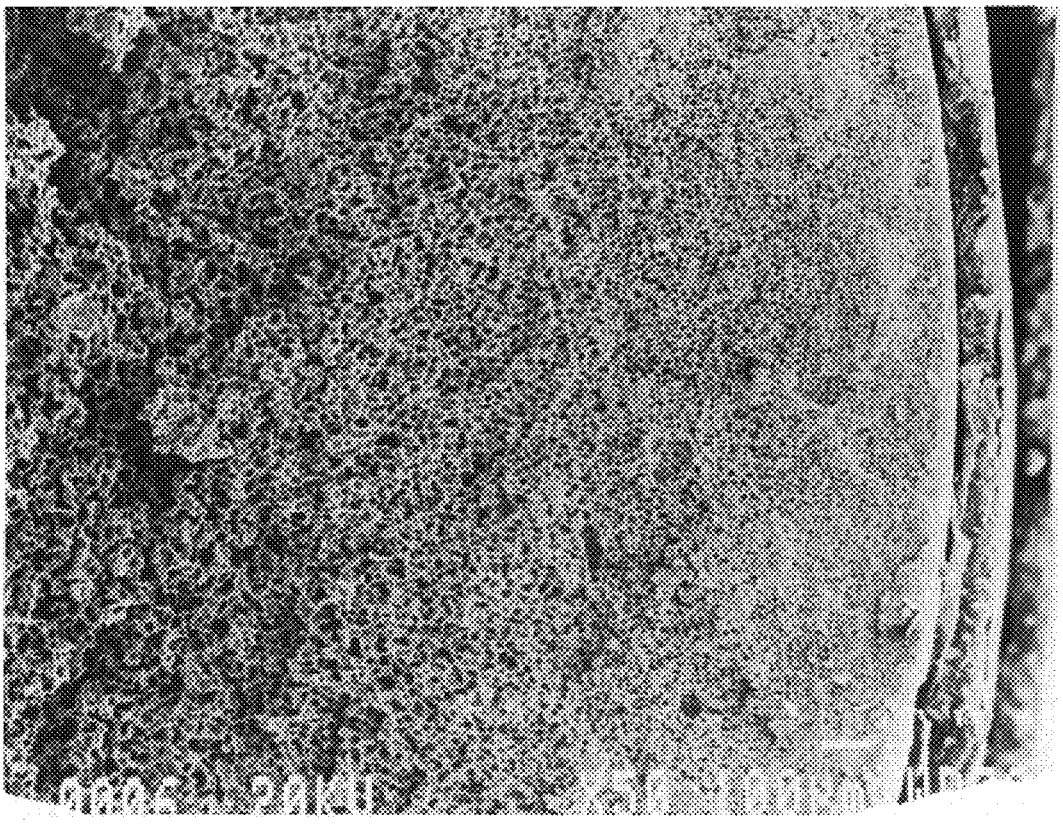
FIGS. 16 and 17 are SEM micrographs of the part of FIG. 15 shown at higher magnifications.
Figure 17:
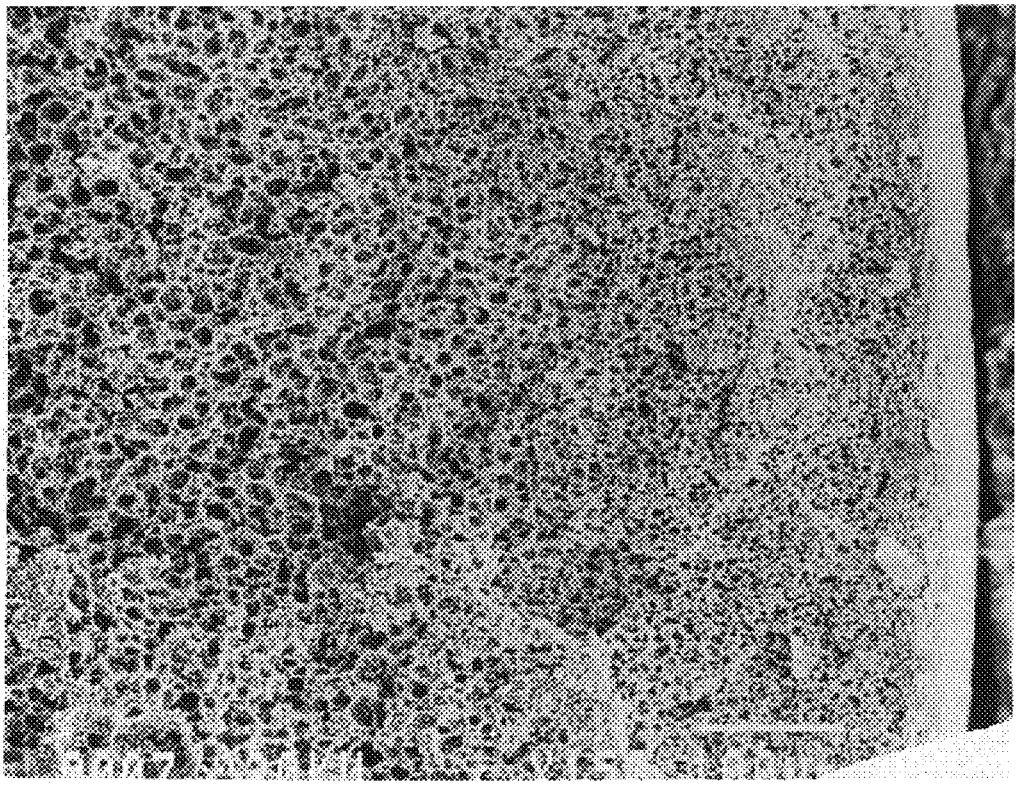
Figure 18:
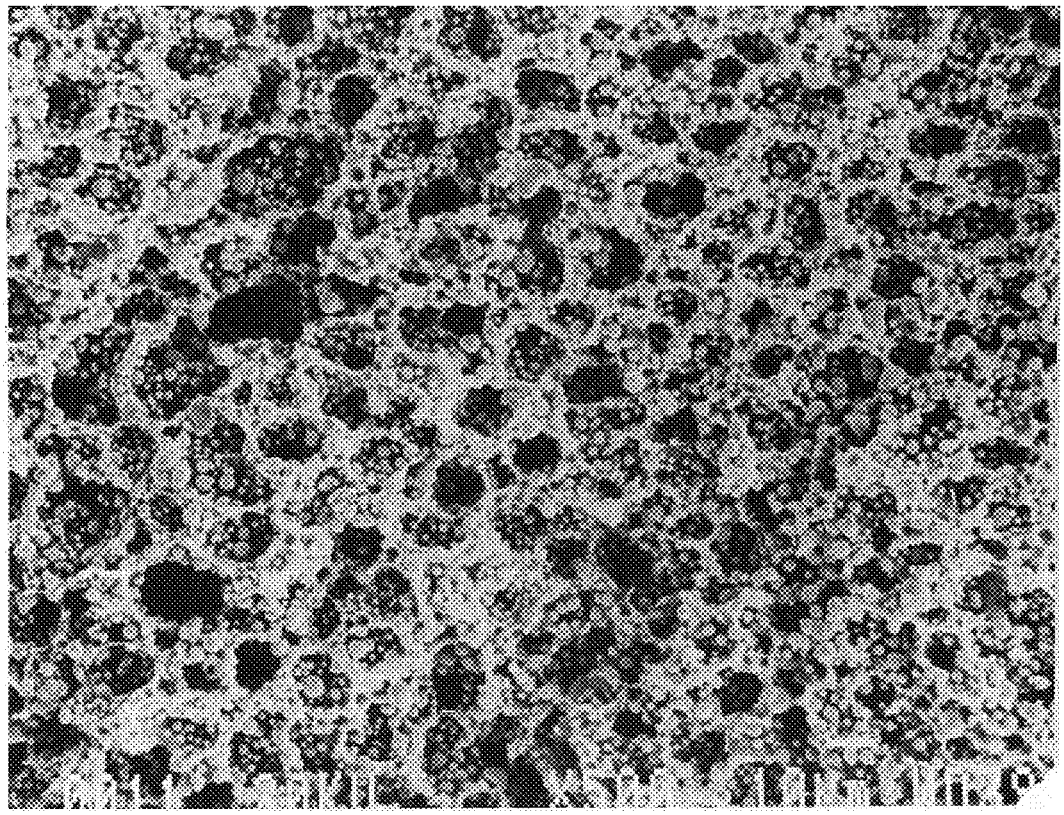
FIG. 18 is an SEM micrograph of the part of FIG. 15 shown at very high magnification.
Figure 19:
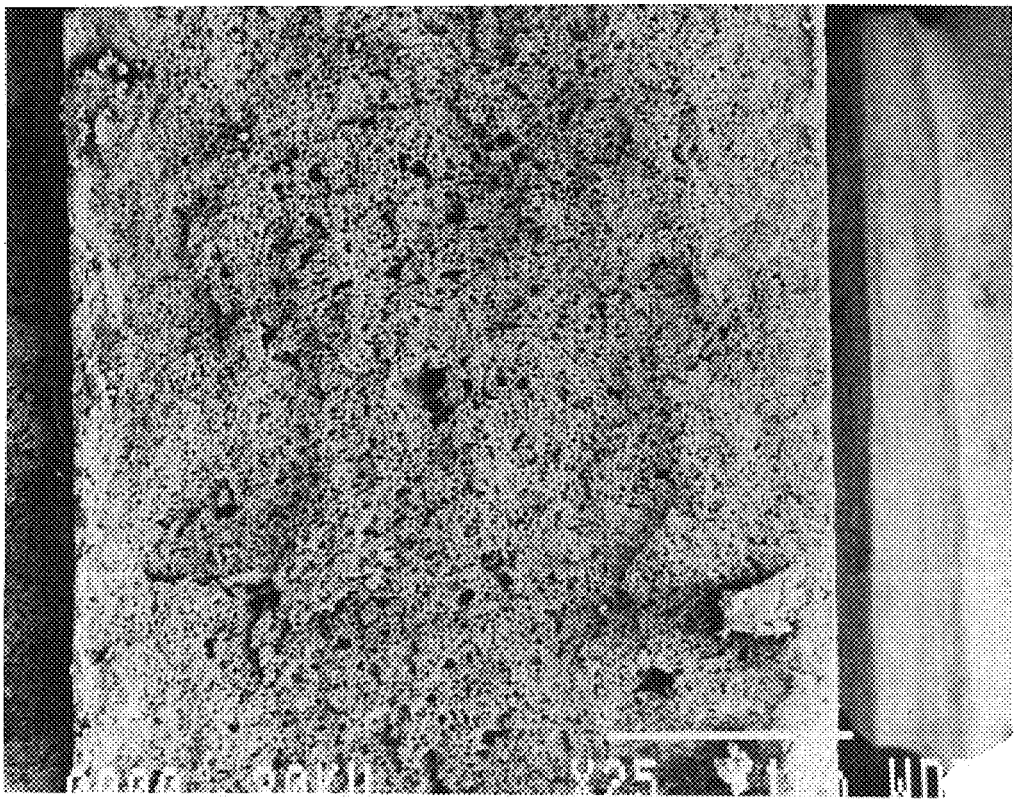
FIG. 19 is an SEM micrograph of a fracture surface of a flat part produced using a custom-formulated feedstock containing polystyrene as the primary binder.
Figure 20:
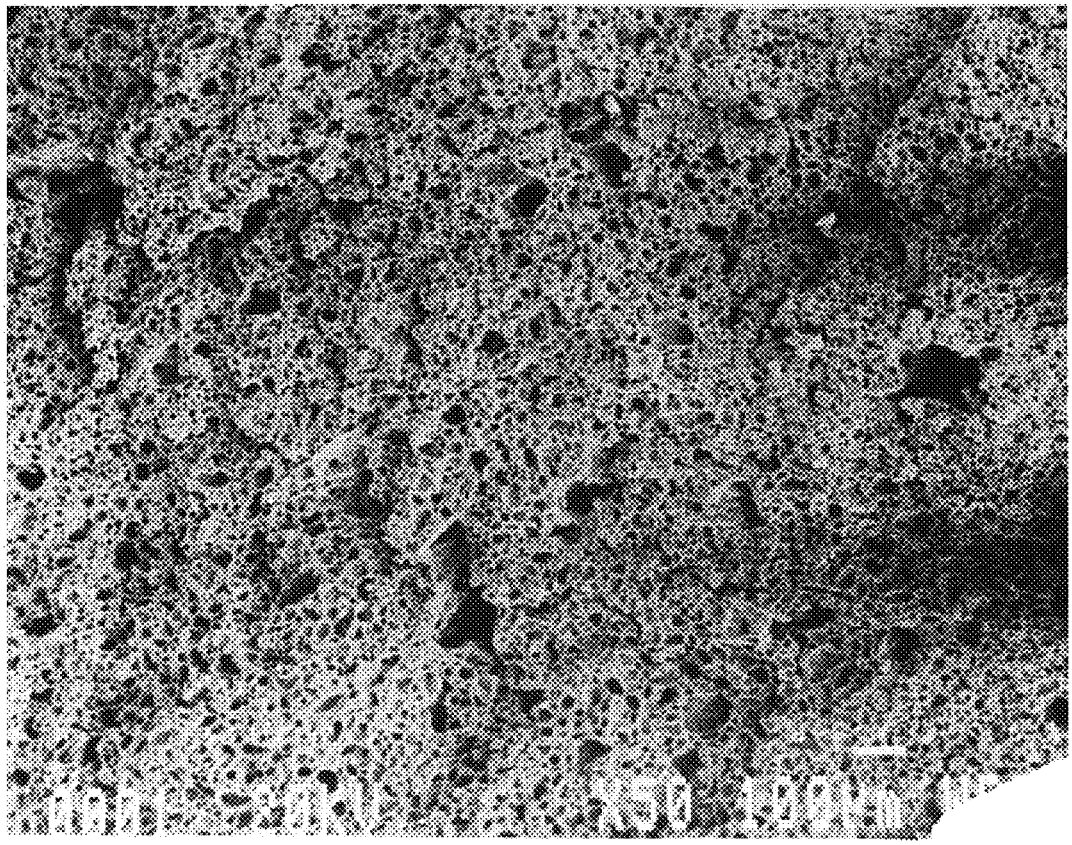
FIGS. 20 and 21 and are SEM micrographs of the part of FIG. 19 shown at higher magnifications.
Figure 21:
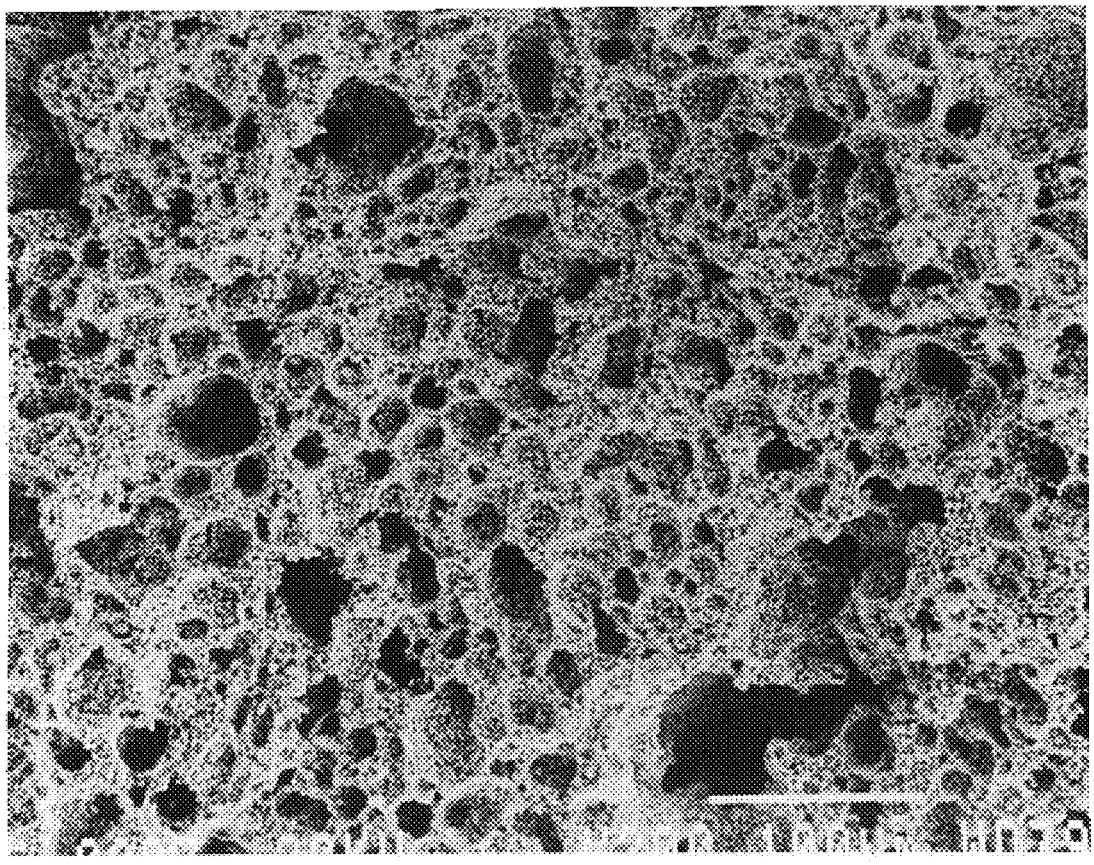

The custom formulated feedstock based on polystyrene binder produced the best results. This binder system was not only easy to process but also yielded relatively uniformly sized pores throughout the structure. FIG. 15 shows fracture surface of a component produced using the feedstock containing polystyrene-based binder system. Clearly, the whole cross section contains oval pores. The coarse pores are located at the center of the cross section while the finer pores are located near the surface. The change in pore size from the center to the surface is quite gradual. The surface skin appears to be dense. It is expected that this structure will be preserved through the sintering process as evidenced by the earlier examples. FIGS. 16 and 17 show the fracture surface of the above component at higher magnifications. The micrograph in FIG. 17 clearly shows that the porous microstructure stretches all the way to the surface of the component, with a gradual change in pore structure from the center to the surface of the sample. Only a thin dense surface layer was noted. FIG. 18 also shows microstructure of fracture surface of a component produced using the feedstock containing polystyrene binder system. The micrograph was taken at a high magnification to reveal the morphology of the pores. The closed pores are small in size. The spherical particles are metal. Metal powder comprising the feedstock are clearly visible forming walls of the pores. FIGS. 19 through 21 show micrograph of fracture surface of a tensile bar produced from the feedstock containing polystyrene. Again, the microstructure is very porous, containing relatively uniform pores.

These results clearly demonstrated that microporous structure using the process of the present invention could be formed in feedstocks of varying binder chemistries. The morphology of the pores and the porosity level in the porous structure depended on the chemistry of the binder, binder level, metal powder size, and other parameters.

Various modifications can be made in the details of the various embodiments of the process and compositions of the present invention, all within the scope and spirit of the invention and defined by the appended claims.

I claim:

1. A process for forming microporous metal parts, the process comprising (a) providing a feedstock comprising metal powder and a binder having a melting point;

(b) injection molding the feedstock to provide a porous green part, the injection molding comprising (1) heating the feedstock to a temperature greater than the melting point of the binder to provide a plasticized feedstock;

(2) mixing a pore-forming agent with the plasticized feedstock; and (3) filling a mold with the plasticized feedstock;

(4) permitting the plasticized feedstock to solidify in the mold;

(c) debindering the porous green part to substantially remove the binder and provide a debindered porous green part; and (d) sintering the debindered porous green part.

2. A process according to claim 1, wherein the injection molding step further comprises applying pressure to the plasticized feedstock, injecting the pore-forming agent into the pressurized plasticized feedstock, and reducing the pressure before filling the mold.

3. A process according to claim 2 wherein the pore-forming agent is injected into the pressurized plasticized feedstock as a fluid.

4. A process according to claim 3 wherein the pore-forming agent is selected from the group consisting of carbon dioxide and nitrogen.

5. A process according to claim 1 wherein the powdered metal is selected from the group consisting of iron, carbon steel, stainless steel, tool steels, metal carbides, aluminum, copper, nickel, gold, silver, titanium, niobium, tantalum, zirconium, copper alloys including bronze, nickel alloys, cobalt alloys, molybdenum alloys, tungsten alloys, intermetallic compounds, iron aluminide, and nickel aluminide.

6. A process according to claim 1 wherein the binder is a thermoplastic polymeric material.

7. A process according to claim 1 wherein the binder is be selected from the group consisting of wax, agar, polyethylene, polyethylene oxide, polypropylene, and polystyrene.

8. A microporous metal part formed according to the process of claim 1.

9. A microporous metal part according to claim 8 and having closed interior pores less than 1000 microns in size and a dense surface skin.

10. A microporous metal part according to claim 9 wherein the interior pores are about 10 microns to 100 microns in size.

11. A process for forming microporous metal structures, the process comprising (a) providing a feedstock comprising metal powder and a binder having a melting point;

(b) extruding the feedstock to provide a porous green structure, the extruding comprising:

(1) heating the feedstock to a temperature greater than the melting point of the binder to provide a plasticized feedstock;

(2) mixing a pore-forming agent with the plasticized feedstock; and (3) passing the plasticized feedstock through a die to impose a shape; and (4) permitting the plasticized feedstock to solidify to form a porous green structure;

(c) debindering the porous green structure to substantially remove the binder and provide a debindered porous green structure; and (d) sintering the debindered porous green structure.

12. A process according to claim 11, wherein the extrusion step further comprises applying pressure to the plasticized feedstock, injecting the pore-forming agent into the pressurized plasticized feedstock, and reducing the pressure before the plasticized feedstock passes through the die.

13. A process according to claim 12 wherein the pore-forming agent is injected into the pressurized plasticized feedstock as a fluid.

14. A process according to claim 13 wherein the pore-forming agent is selected from the group consisting of carbon dioxide and nitrogen.

15. A process according to claim 11 wherein the powdered metal is selected from the group consisting of iron, carbon steel, stainless steel, tool steels, metal carbides, aluminum, copper, nickel, gold, silver, titanium, niobium, tantalum, zirconium, copper alloys including bronze, nickel alloys, cobalt alloys, molybdenum alloys, tungsten alloys, iron aluminide, and nickel aluminide.

16. A process according to claim 11 wherein the binder is a thermoplastic polymeric material.

17. A process according to claim 11 wherein the binder is be selected from the group consisting of wax, agar, polyethylene, polyethylene oxide, polypropylene, and polystyrene.

18. A microporous metal structure formed according to the process of claim 11.

19. A process for forming microporous ceramic parts, the process comprising (a) providing a feedstock comprising powdered ceramic material and a binder having a melting point;

(b) injection molding the feedstock to provide a porous green part, the injection molding comprising (1) heating the feedstock to a temperature greater than the melting point of the binder to provide a plasticized feedstock;

(2) mixing a pore-forming agent with the plasticized feedstock; and (3) filling a mold with the plasticized feedstock;

(4) permitting the plasticized feedstock to solidify in the mold;

(c) debindering the porous green part to substantially remove the binder and provide a debindered porous green part; and (d) sintering the debindered porous green part.

20. A process for forming microporous ceramic structures, the process comprising (a) providing a feedstock comprising powdered ceramic material and a binder having a melting point;

(b) extruding the feedstock to provide a porous green structure, the extruding comprising:

(1) heating the feedstock to a temperature greater than the melting point of the binder to provide a plasticized feedstock;

(2) mixing a pore-forming agent with the plasticized feedstock; and (3) passing the plasticized feedstock through a die to impose a shape; and (4) permitting the plasticized feedstock to solidify to form a porous green structure;

(c) debindering the porous green structure to substantially remove the binder and provide a debindered porous green structure; and (d) sintering the debindered porous green structure.

* * * * *

UNITED STATES PATENT AND TRADEMARK OFFICE

CERTIFICATE OF CORRECTION

PATENT NO. : 6,759,004 B1
DATED : July 6, 2004
INVENTOR(S) : Ratnesh K. Dwivedi

It is certified that error appears in the above-identified patent and that said Letters Patent is hereby corrected as shown below:

Column 4,
Line 30, start new paragraph with “Fig. 8...”;

Column 12,
Line 40, replace “Theological” with --rheological --;

Column 13,
Line 35, replace “6-5” with -- 6.5 --.

Signed and Sealed this

Twenty-eighth Day of September, 2004

JON W. DUDAS
*Director of the United States Patent and Trademark Office*